US009462828B2

(12) United States Patent
Le Roux

(10) Patent No.: US 9,462,828 B2
(45) Date of Patent: Oct. 11, 2016

(54) APPARATUS FOR INTRODUCING OBJECTS INTO FILTER ROD MATERIAL

(75) Inventor: Gerhard Malan Le Roux, Paarl (ZA)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 377 days.

(21) Appl. No.: 13/255,859

(22) PCT Filed: Mar. 9, 2010

(86) PCT No.: PCT/EP2010/052974

§ 371 (c)(1),
(2), (4) Date: Nov. 28, 2011

(87) PCT Pub. No.: WO2010/103000

PCT Pub. Date: Sep. 16, 2010

(65) Prior Publication Data

US 2012/0065042 A1 Mar. 15, 2012

(30) Foreign Application Priority Data

Mar. 9, 2009 (ZA) ..... 2009/01679

(51) Int. Cl.
*A24D 3/02* (2006.01)
*A24D 3/06* (2006.01)

(52) U.S. Cl.
CPC ..... *A24D 3/0216* (2013.01); *A24D 3/061* (2013.01)

(58) Field of Classification Search
CPC ..... A24D 3/0216
USPC ..... 493/39, 42, 46, 47, 48, 49, 941; 53/239, 53/240, 244, 249, 250, 252; 131/337; 221/135
See application file for complete search history.

(56) References Cited

U.S. PATENT DOCUMENTS

| | | | | |
|---|---|---|---|---|
| 1,726,737 | A | 9/1929 | Harris | |
| 2,755,206 | A | 7/1956 | Statia, Sr. | |
| 2,863,461 | A | 12/1958 | Frost, Jr. | |
| 3,339,558 | A | 9/1967 | Waterbury | |
| 3,366,121 | A | 1/1968 | Carty | |
| 3,370,514 | A * | 2/1968 | Rome | 493/41 |
| 3,390,686 | A | 7/1968 | Irby, Jr. et al. | |
| 3,428,049 | A | 2/1969 | Cogbill | |

(Continued)

FOREIGN PATENT DOCUMENTS

| | | | |
|---|---|---|---|
| CN | 1849209 | A | 10/2006 |
| DE | 102007043776 | A1 | 3/2009 |

(Continued)

OTHER PUBLICATIONS

International Search Report and Written Opinion, mailed Jun. 16, 2010, for PCT International Application No. PCT/EP2010/052974, filed Mar. 9, 2010.

(Continued)

*Primary Examiner* — Christopher Harmon
(74) *Attorney, Agent, or Firm* — Cantor Colburn LLP

(57) ABSTRACT

An apparatus for inserting or otherwise introducing objects such as fluid-containing capsules into filter rod material during filter rod manufacture comprises an object store and an object transfer mechanism having one or more reciprocating transfer units configured to receive objects from the object store and to output objects in ordered sequence.

38 Claims, 25 Drawing Sheets

(56) References Cited

U.S. PATENT DOCUMENTS 3,502,084 A 3/1970 Carty
3,513,859 A 5/1970 Carty
3,525,582 A 8/1970 Waterbury
3,547,130 A 12/1970 Flint
3,847,064 A * 11/1974 Berger ..... 493/44
3,884,246 A 5/1975 Walker et al.
4,184,412 A * 1/1980 Hall ..... 493/45
4,425,107 A * 1/1984 Hall ..... 493/48
4,865,056 A 9/1989 Tamaoki et al.
4,889,144 A 12/1989 Tateno et al.
4,903,714 A 2/1990 Barnes
4,913,166 A 4/1990 Christensson
4,966,169 A 10/1990 Waddell et al.
4,967,772 A 11/1990 Waddell et al.
4,991,605 A 2/1991 Keritsis
5,000,198 A 3/1991 Nakajima
5,016,655 A 5/1991 Waddell et al.
5,052,413 A 10/1991 Baker et al.
5,060,673 A 10/1991 Lehman
5,064,099 A * 11/1991 Iwako ..... 222/142
5,065,800 A 11/1991 Sagawa et al.
5,067,500 A 11/1991 Keritsis
5,074,321 A 12/1991 Gentry et al.
5,085,232 A 2/1992 Raker et al.
5,101,839 A 4/1992 Jakob et al.
5,105,836 A 4/1992 Gentry et al.
5,113,878 A 5/1992 Polese
5,129,408 A 7/1992 Jakob et al.
5,131,416 A 7/1992 Gentry
5,133,367 A 7/1992 Keritsis
5,137,034 A 8/1992 Perfetti et al.
5,139,056 A 8/1992 Sagawa et al.
5,141,007 A 8/1992 Raker et al.
5,144,966 A 9/1992 Washington
5,159,944 A 11/1992 Arzonico et al.
5,176,154 A 1/1993 Sagawa et al.
5,186,185 A 2/1993 Mashiko et al.
5,221,502 A 6/1993 Washington
5,261,425 A 11/1993 Raker et al.
5,271,419 A 12/1993 Arzonico et al.
5,327,917 A 7/1994 Lekwauwa
5,331,981 A 7/1994 Tamaoki et al.
5,348,062 A * 9/1994 Hartzell et al. ..... 141/186
5,360,023 A 11/1994 Blakley et al.
5,396,911 A 3/1995 Casey et al.
5,415,186 A 5/1995 Casey et al.
5,417,261 A * 5/1995 Kanzler et al. ..... 141/313
5,472,002 A 12/1995 Covarrubias
5,479,949 A 1/1996 Battard et al.
5,494,055 A 2/1996 Noe et al.
5,501,238 A 3/1996 Von Borstel et al.
5,549,124 A 8/1996 Dorsey
5,598,868 A 2/1997 Jakob et al.
5,662,126 A 9/1997 Charlton et al.
5,724,997 A 3/1998 Smith et al.
5,746,231 A 5/1998 Lesser et al.
5,829,449 A 11/1998 Hersh et al.
5,839,447 A 11/1998 Lesser et al.
5,860,428 A 1/1999 Lesser et al.
5,875,824 A 3/1999 Atwell et al.
5,975,086 A 11/1999 Lesser et al.
6,079,418 A 6/2000 Russo
6,082,370 A 7/2000 Russo
6,138,683 A 10/2000 Hersh et al.
6,164,288 A 12/2000 Lesser et al.
6,325,859 B1 12/2001 De Roos et al.
6,415,798 B1 7/2002 Hersh et al.
6,443,160 B1 9/2002 Boldrini et al.
6,470,894 B2 10/2002 Hersh et al.
6,516,809 B1 2/2003 Schumacher
6,530,377 B1 3/2003 Lesser et al.
6,584,980 B1 7/2003 Russo
6,631,722 B2 10/2003 MacAdam et al.
6,732,740 B2 5/2004 Schumacher
6,792,953 B2 9/2004 Lesser et al.
6,805,174 B2 10/2004 Smith et al.
6,883,523 B2 4/2005 Dante
7,093,625 B2 8/2006 Smith et al.
7,104,265 B2 9/2006 Von Borstel
7,115,085 B2 10/2006 Deal
7,237,558 B2 7/2007 Clark et al.
7,240,678 B2 7/2007 Crooks et al.
7,249,605 B2 7/2007 MacAdam et al.
7,381,175 B2 * 6/2008 Dawson et al. ..... 493/47
7,415,815 B2 * 8/2008 Vodonos ..... 53/473
7,479,098 B2 1/2009 Thomas et al.
7,479,099 B2 1/2009 Scott et al.
7,546,839 B2 6/2009 Markel
7,578,298 B2 8/2009 Karles et al.
7,654,945 B2 2/2010 Deal
7,669,604 B2 3/2010 Crooks et al.
7,673,557 B2 3/2010 Bienvenu et al.
7,713,184 B2 5/2010 Scott et al.
7,744,922 B2 6/2010 Mane et al.
7,754,239 B2 7/2010 Mane et al.
7,757,835 B2 7/2010 Garthaffner et al.
7,789,089 B2 9/2010 Dube et al.
7,793,665 B2 9/2010 Dube et al.
7,810,508 B2 10/2010 Wyss-Peters et al.
7,827,997 B2 11/2010 Crooks et al.
7,833,146 B2 11/2010 Deal
7,836,895 B2 11/2010 Dube et al.
7,856,989 B2 12/2010 Karles et al.
7,856,990 B2 12/2010 Crooks et al.
7,972,254 B2 7/2011 Stokes et al.
7,975,877 B2 7/2011 Garthaffner et al.
7,984,719 B2 7/2011 Dube et al.
7,998,274 B2 8/2011 Rodrigues et al.
8,066,011 B2 11/2011 Clark et al.
8,079,369 B2 12/2011 Andresen et al.
8,083,658 B2 * 12/2011 Veluz et al. ..... 493/39
8,142,339 B2 3/2012 Deal
8,157,918 B2 4/2012 Becker et al.
8,186,359 B2 5/2012 Ademe et al.
8,235,056 B2 8/2012 Zhuang et al.
8,262,550 B2 9/2012 Barnes et al.
8,303,474 B2 11/2012 Iliev et al.
8,353,811 B2 1/2013 Shen et al.
8,381,947 B2 2/2013 Garthaffner et al.
8,459,272 B2 6/2013 Karles et al.
8,470,215 B2 6/2013 Zhang
8,496,011 B2 7/2013 Andresen et al.
8,512,213 B2 8/2013 Deal
8,882,647 B2 * 11/2014 Thomas et al. ..... 493/39
2002/0117180 A1 8/2002 Hersh et al.
2002/0119874 A1 * 8/2002 Heitmann et al. ..... 493/39
2002/0179103 A1 12/2002 Hersh et al.
2003/0087566 A1 5/2003 Carlyle et al.
2003/0098033 A1 5/2003 Macadam
2003/0106561 A1 6/2003 Schumacher
2003/0183239 A1 10/2003 Lesser et al.
2004/0020554 A1 2/2004 Smith et al.
2004/0032036 A1 2/2004 Subramaniam et al.
2004/0074507 A1 4/2004 MacAdam et al.
2004/0159327 A1 8/2004 Dante
2004/0173227 A1 9/2004 Von Borstel
2004/0234590 A1 11/2004 Mane et al.
2004/0261807 A1 12/2004 Dube
2005/0000531 A1 1/2005 Shi
2005/0066980 A1 3/2005 Crooks et al.
2005/0066981 A1 3/2005 Crooks et al.
2005/0066982 A1 3/2005 Clark
2005/0066983 A1 3/2005 Clark et al.
2005/0066984 A1 3/2005 Crooks
2005/0070409 A1 3/2005 Deal
2005/0112228 A1 5/2005 Smith et al.
2005/0123601 A1 6/2005 Mane et al.
2005/0123757 A1 6/2005 Subramaniam
2005/0166933 A1 8/2005 Lesser et al.
2005/0268926 A1 12/2005 Hsu
2006/0112963 A1 6/2006 Scott et al.
2006/0112964 A1 6/2006 Jupe et al.
2006/0144412 A1 7/2006 Mishra et al.
2006/0157075 A1 7/2006 Gauthier

(56) References Cited

U.S. PATENT DOCUMENTS

| | | | | |
|---|---|---|---|---|
| 2006/0174901 | A1 | 8/2006 | Karles et al. | |
| 2006/0207616 | A1 | 9/2006 | Hapke et al. | |
| 2006/0225754 | A1 | 10/2006 | Markel | |
| 2006/0225755 | A1 | 10/2006 | Markel | |
| 2006/0264130 | A1 | 11/2006 | Karles et al. | |
| 2006/0272663 | A1 | 12/2006 | Dube | |
| 2006/0278249 | A1 | 12/2006 | Von Borstel | |
| 2006/0289023 | A1 | 12/2006 | Von Borstel | |
| 2006/0293157 | A1 | 12/2006 | Deal | |
| 2007/0012327 | A1 | 1/2007 | Karles et al. | |
| 2007/0068540 | A1* | 3/2007 | Thomas et al. | 131/88 |
| 2007/0084476 | A1 | 4/2007 | Yang et al. | |
| 2007/0095357 | A1 | 5/2007 | Besso et al. | |
| 2007/0119467 | A1 | 5/2007 | Akhmetshin et al. | |
| 2007/0181140 | A1 | 8/2007 | Xue et al. | |
| 2007/0227548 | A1 | 10/2007 | Crooks | |
| 2007/0246054 | A1 | 10/2007 | Gedevanishvili et al. | |
| 2007/0267033 | A1 | 11/2007 | Mishra et al. | |
| 2007/0284012 | A1 | 12/2007 | Smith et al. | |
| 2008/0017206 | A1 | 1/2008 | Becker et al. | |
| 2008/0029106 | A1 | 2/2008 | Mishra et al. | |
| 2008/0029111 | A1 | 2/2008 | Dube et al. | |
| 2008/0047571 | A1 | 2/2008 | Braunshteyn et al. | |
| 2008/0142028 | A1 | 6/2008 | Fagg | |
| 2008/0156336 | A1 | 7/2008 | Wyss-Peters et al. | |
| 2008/0163877 | A1 | 7/2008 | Zhuang et al. | |
| 2008/0163879 | A1 | 7/2008 | Rodrigues et al. | |
| 2008/0173320 | A1 | 7/2008 | Dunlap et al. | |
| 2008/0230076 | A1 | 9/2008 | Wick et al. | |
| 2008/0302373 | A1* | 12/2008 | Stokes et al. | 131/84.1 |
| 2008/0302376 | A1 | 12/2008 | Karles et al. | |
| 2008/0314399 | A1 | 12/2008 | Ricketts et al. | |
| 2009/0038628 | A1 | 2/2009 | Shen et al. | |
| 2009/0038629 | A1 | 2/2009 | Ergle et al. | |
| 2009/0039102 | A1 | 2/2009 | Garthaffner et al. | |
| 2009/0050163 | A1 | 2/2009 | Hartmann et al. | |
| 2009/0071488 | A1 | 3/2009 | Markel | |
| 2009/0090372 | A1 | 4/2009 | Thomas et al. | |
| 2009/0118109 | A1 | 5/2009 | Scott et al. | |
| 2009/0145724 | A1 | 6/2009 | Garthaffner et al. | |
| 2009/0166376 | A1 | 7/2009 | Garthaffner et al. | |
| 2009/0194118 | A1 | 8/2009 | Ademe et al. | |
| 2009/0208568 | A1 | 8/2009 | Hannetel et al. | |
| 2009/0277465 | A1 | 11/2009 | Karles et al. | |
| 2009/0288667 | A1 | 11/2009 | Andresen et al. | |
| 2009/0288669 | A1 | 11/2009 | Hutchens | |
| 2009/0288672 | A1 | 11/2009 | Hutchens | |
| 2009/0293894 | A1 | 12/2009 | Cecchetto et al. | |
| 2009/0304784 | A1 | 12/2009 | Mane et al. | |
| 2010/0108081 | A1 | 5/2010 | Blevins Joyce et al. | |
| 2010/0108084 | A1 | 5/2010 | Norman et al. | |
| 2010/0184576 | A1 | 7/2010 | Prestia et al. | |
| 2010/0210437 | A1 | 8/2010 | Scott et al. | |
| 2010/0236561 | A1 | 9/2010 | Barnes et al. | |
| 2010/0294290 | A1 | 11/2010 | Zhang | |
| 2011/0023896 | A1 | 2/2011 | Dube | |
| 2011/0036367 | A1 | 2/2011 | Saito | |
| 2011/0053745 | A1 | 3/2011 | Iliev et al. | |
| 2011/0059831 | A1 | 3/2011 | Deal | |
| 2011/0100387 | A1 | 5/2011 | Karles | |
| 2011/0162662 | A1 | 7/2011 | Nikolov et al. | |
| 2011/0162665 | A1 | 7/2011 | Burov et al. | |
| 2011/0230320 | A1 | 9/2011 | Stokes et al. | |
| 2012/0037173 | A1 | 2/2012 | Clark et al. | |
| 2012/0061025 | A1 | 3/2012 | Andresen et al. | |
| 2012/0088643 | A1 | 4/2012 | Thomas et al. | |
| 2012/0167905 | A1 | 7/2012 | Becker et al. | |
| 2012/0220438 | A1 | 8/2012 | Herholdt et al. | |
| 2012/0270710 | A1 | 10/2012 | Deal | |
| 2012/0298120 | A1 | 11/2012 | Barnes et al. | |
| 2012/0302416 | A1 | 11/2012 | Barnes et al. | |
| 2013/0029822 | A1 | 1/2013 | Iliev | |
| 2013/0180534 | A1 | 7/2013 | Shen et al. | |

FOREIGN PATENT DOCUMENTS

| | | | |
|---|---|---|---|
| EP | 636324 | B1 | 4/1998 |
| FR | 2089576 | A5 | 1/1972 |
| GB | 1601221 | A | 10/1981 |
| GB | 2461858 | A | 1/2010 |
| JP | 03198766 | A | 8/1991 |
| JP | 06-135542 | A | 5/1994 |
| JP | 08182492 | A | 7/1996 |
| JP | 2000014377 | A | 1/2000 |
| JP | 3096410 | B2 | 10/2000 |
| JP | 3171670 | B2 | 5/2001 |
| JP | 2005318806 | A | 11/2005 |
| JP | 4207188 | B2 | 1/2009 |
| JP | 2009504175 | A | 2/2009 |
| JP | 2009508524 | A | 3/2009 |
| WO | 9409653 | A1 | 5/1994 |
| WO | 0110252 | A1 | 2/2001 |
| WO | 0135918 | A1 | 5/2001 |
| WO | 0243513 | A1 | 6/2002 |
| WO | 0247498 | A1 | 6/2002 |
| WO | 03009711 | A1 | 2/2003 |
| WO | 2007038053 | A1 | 4/2007 |
| WO | 2007060543 | A2 | 5/2007 |
| WO | 2009034232 | A1 | 3/2009 |
| WO | 2009036851 | A2 | 3/2009 |
| WO | 2009094859 | A1 | 8/2009 |
| WO | 2009098462 | A1 | 8/2009 |
| WO | 2009157240 | A1 | 12/2009 |
| WO | 2011028372 | A1 | 3/2011 |

OTHER PUBLICATIONS

International Preliminary Report on Patentability, mailed Apr. 7, 2011, for PCT International Application No. PCT/EP2010/052974, filed Mar. 9, 2010.

Japanese Office Action issued on Mar. 6, 2012 for Patent Application No. 2011-553425.

Search Report for Chinese Patent Application No. 201080020385.8 dated Apr. 24, 2013.

Office Action for Chinese Patent Application No. 201080020385.8 dated May 6, 2013.

* cited by examiner

APPARATUS FOR INTRODUCING OBJECTS INTO FILTER ROD MATERIAL

CLAIM FOR PRIORITY

This application is a National Stage Entry entitled to and hereby claims priority under 35 U.S.C. §§365 and 371 to corresponding PCT Application No. PCT/EP2010/052974, filed Mar. 9, 2010, which in turn claims priority to South African Application Serial No. ZA 2009/01679, filed Mar. 9, 2009. The entire contents of the aforementioned applications are herein expressly incorporated by reference.

This invention relates to an apparatus for introducing objects such as fluid-containing capsules into filter rod material during manufacture of smoking article filter rods.

It is known to provide a frangible capsule containing a flavourant, for example menthol, inside the filter of a smoking article such as a cigarette. By applying pressure to the outside of the filter, the smoker may break the capsule therein and release the flavourant. Thus, a smoker wishing to add flavour to the inhaled gaseous flow from the cigarette may do so by simply squeezing the filter.

In known filter rod making machines, capsules are incorporated into cigarette filter rods by supplying capsules from a capsule reservoir into the pockets of a delivery wheel which rotates and guides the capsules into a flow of filter tow. The tow containing the capsules is subsequently shaped into a rod, paper wrapped and cut into segments to form individual capsule-containing rod segments.

The present invention provides an alternative approach for inserting objects such as frangible capsules into filter rods.

The present invention provides an apparatus for introducing objects into filter rod material during filter rod manufacture, comprising an object store and an object transfer mechanism having one or more reciprocating transfer units configured to receive objects from the object store and to output objects in ordered sequence.

The apparatus may be in combination with a filter rod manufacturing machine configured to manufacture filter rods from the filter rod material. The one or more reciprocating transfer units may be configured to output objects in an ordered sequence such that each filter rod has a desired arrangement of one or more objects longitudinally disposed therein.

The object transfer mechanism may comprise, for example, two or four reciprocating transfer units configured to receive objects from the output store and to output objects in ordered sequence.

The apparatus may further comprise a combining member configured to combine the objects output by the transfer units and to output a combined sequence of objects for introduction into the filter rod material.

The apparatus may further comprise an object propulsion mechanism configured to propel objects from the object transfer mechanism such that the objects are introduced into the filter rod material.

A reciprocating transfer unit may receive objects in a first position and in a second position and may be configured such that objects received in the first position are output from the transfer unit when the transfer unit is in the second position; and such that objects received in the second position are output from the transfer unit when the transfer unit is in the first position.

The invention also provides a method for introducing objects into filter rod material during filter rod manufacture, comprising: receiving objects at one or more reciprocating transfer members, from an object store; and outputting objects from the one or more reciprocating transfer member in ordered sequence.

In order that the invention may be more fully understood embodiments thereof will be described by way of example with reference to the accompanying drawings in which.

Figure 2:
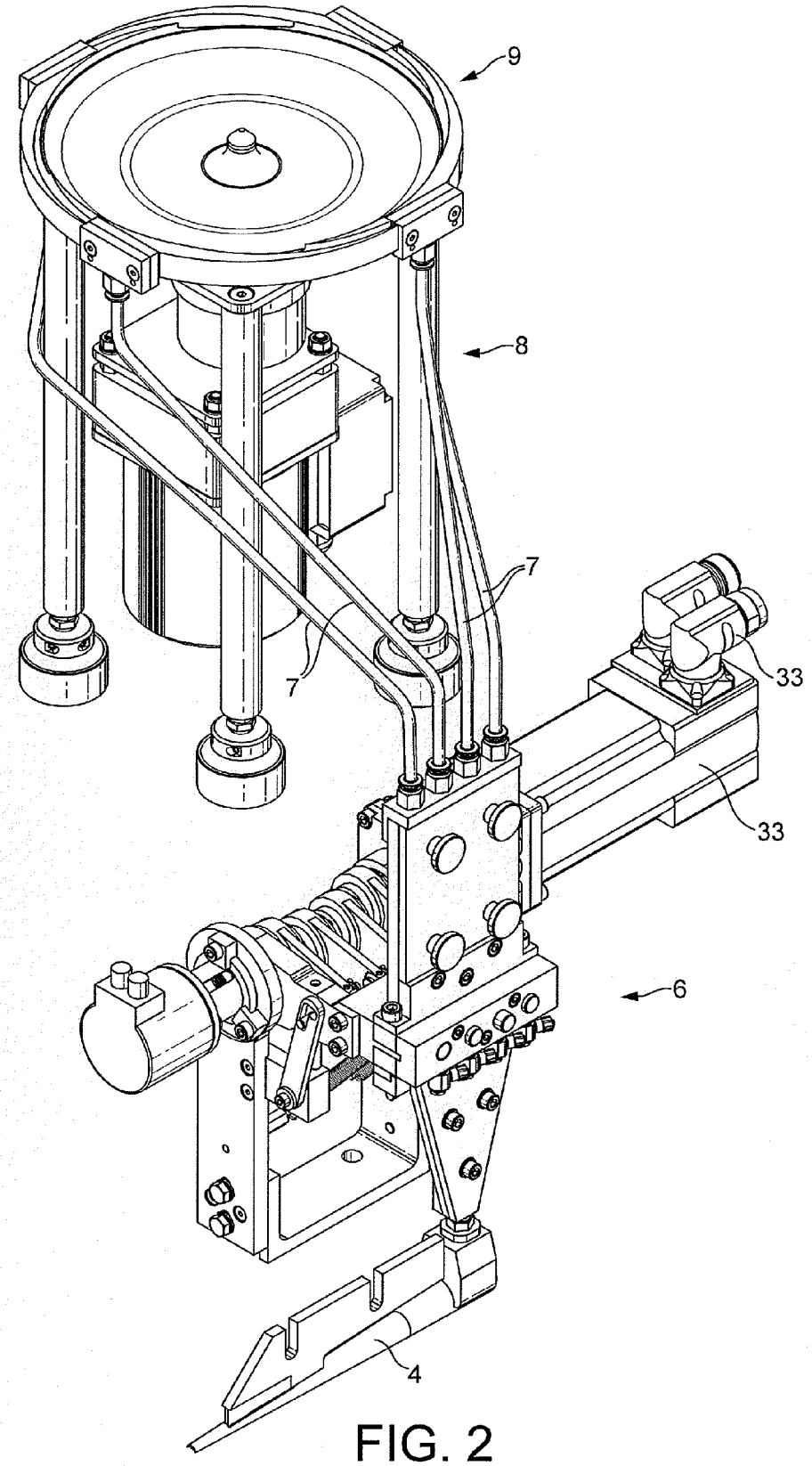
FIG. 2 shows the capsule insert mechanism connected to a capsule feed unit.
Figure 2A:
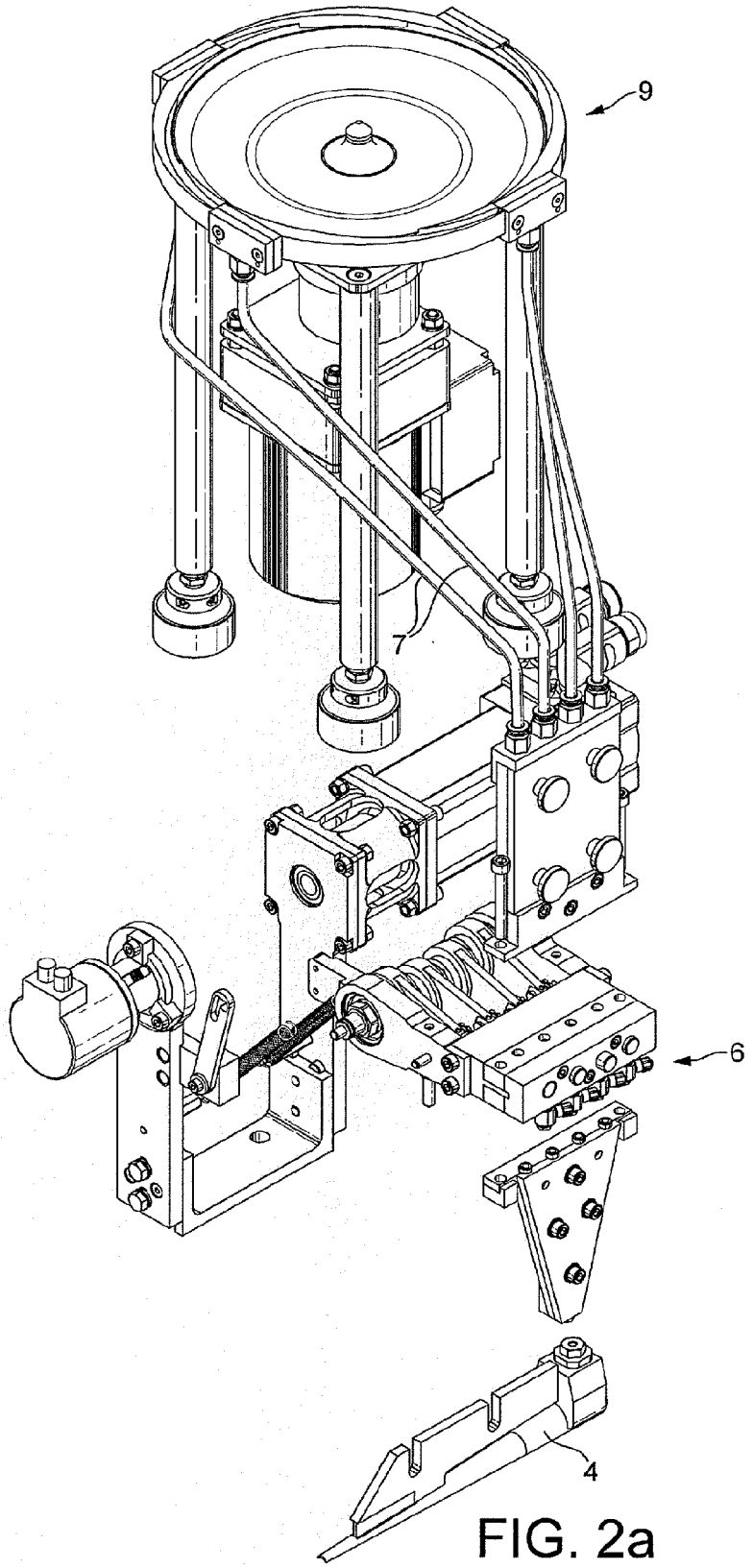

FIG. 2*a* is an exploded view of the apparatus of FIG. 2.

Figure 3:
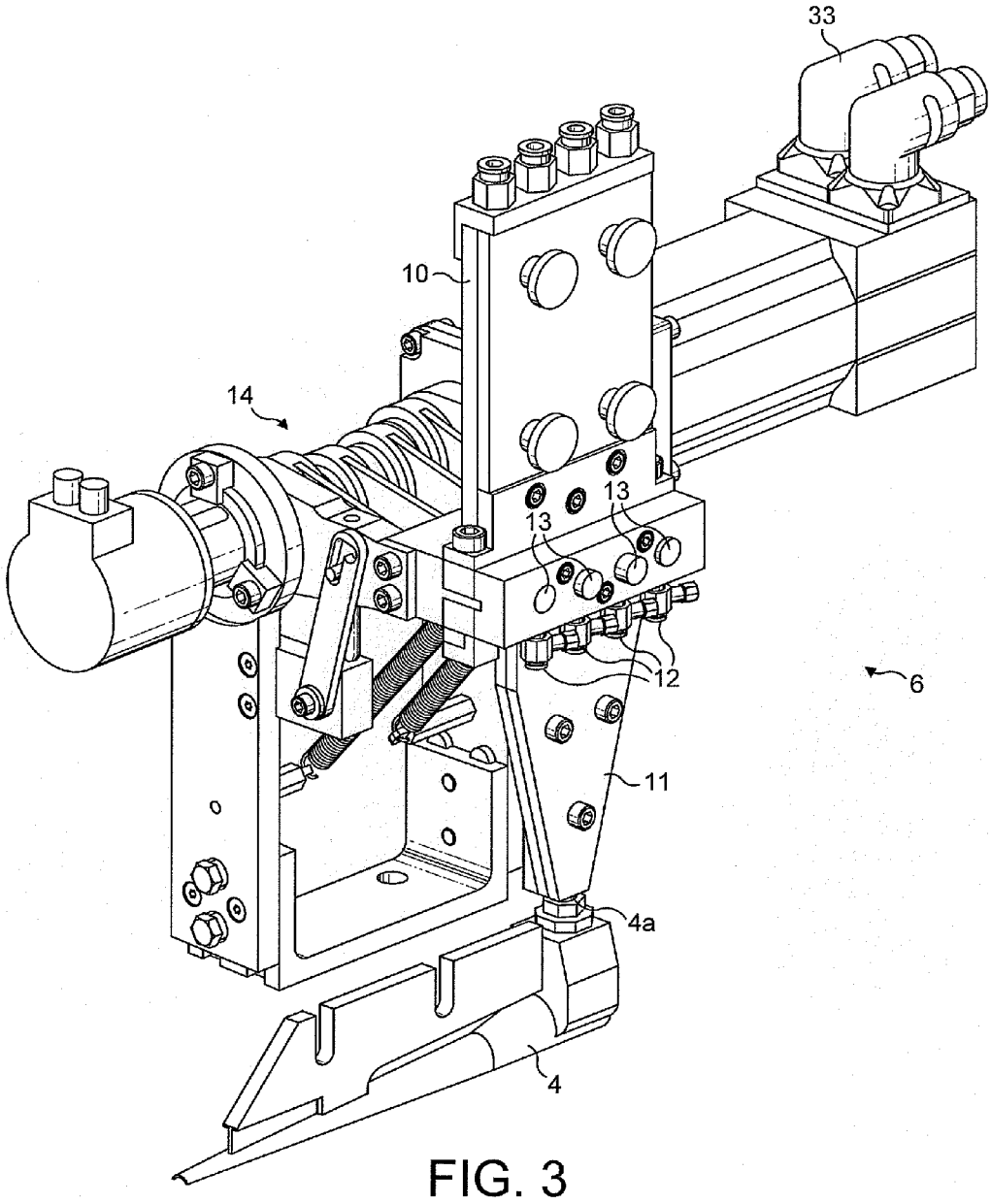

FIG. 3 is a more detailed perspective view of the capsule insert mechanism.

Figure 3A:
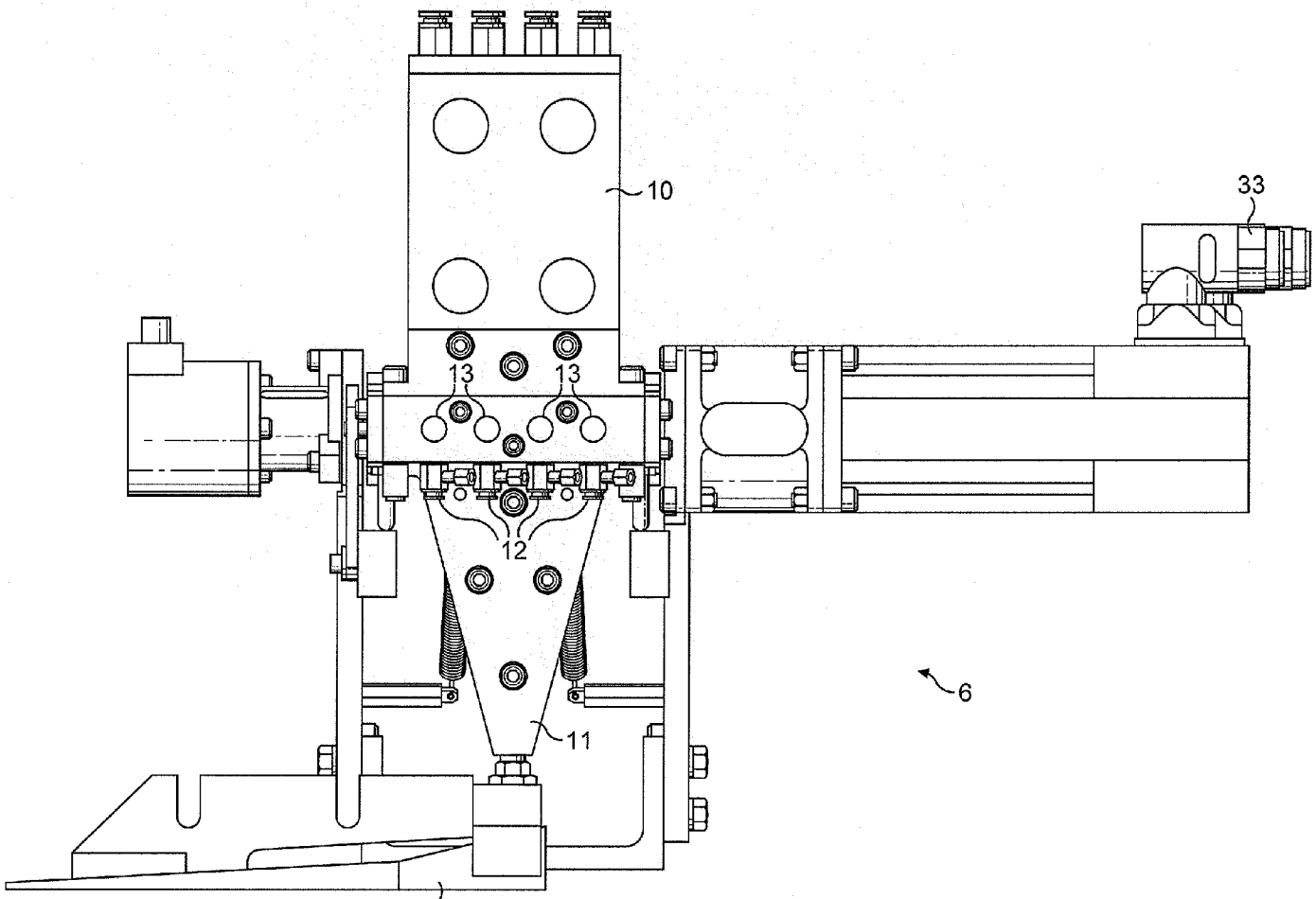

FIG. 3*a* is a side view of the capsule insert mechanism.

Figure 3B:
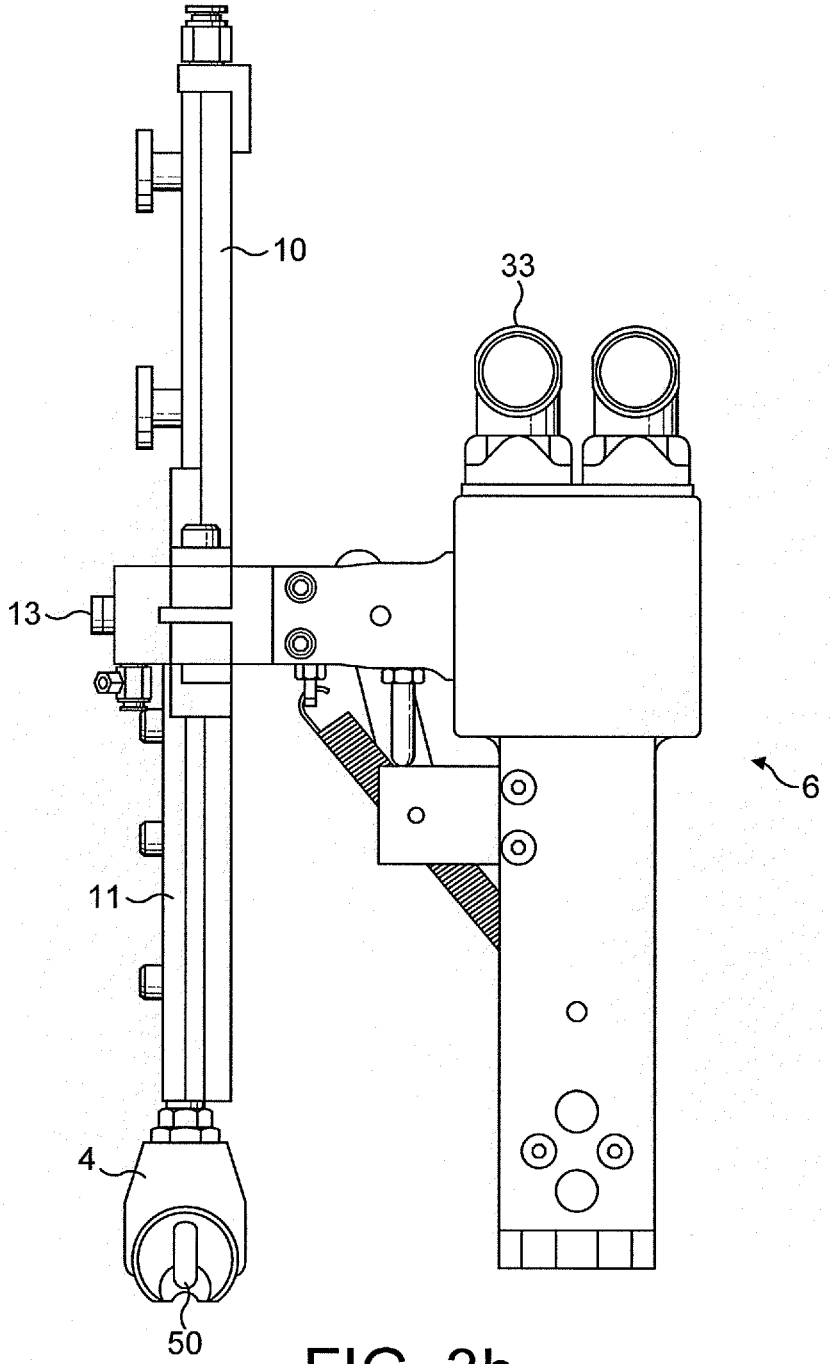

FIG. 3*b* is a rear view of the capsule insert mechanism.

Figure 4:
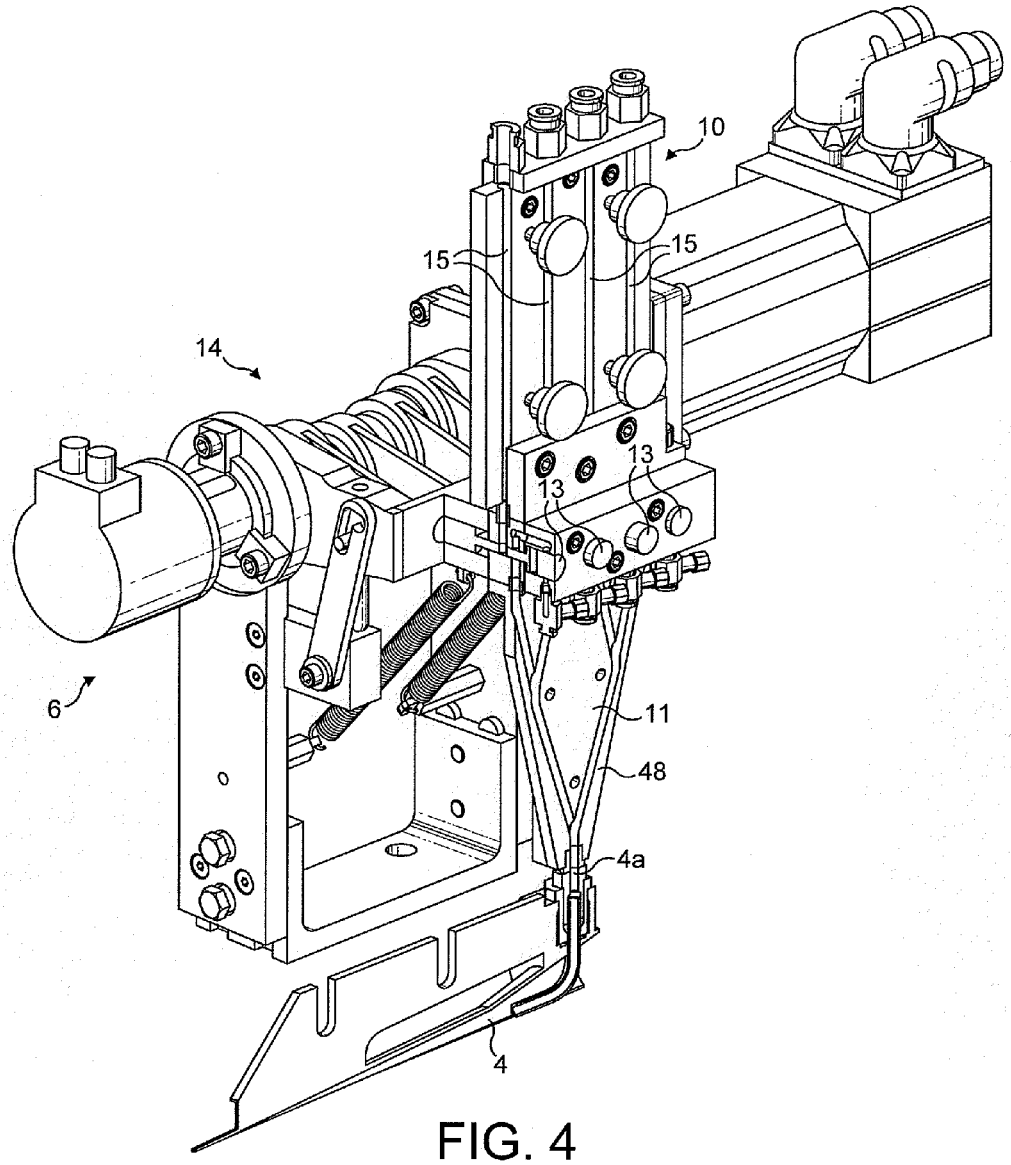

FIG. 4 is a perspective view of the capsule insert mechanism and illustrates a sectional view of the hopper, transfer mechanism and manifold assembly of the capsule insert unit and the tongue of the filter rod making machine.

Figure 4A:
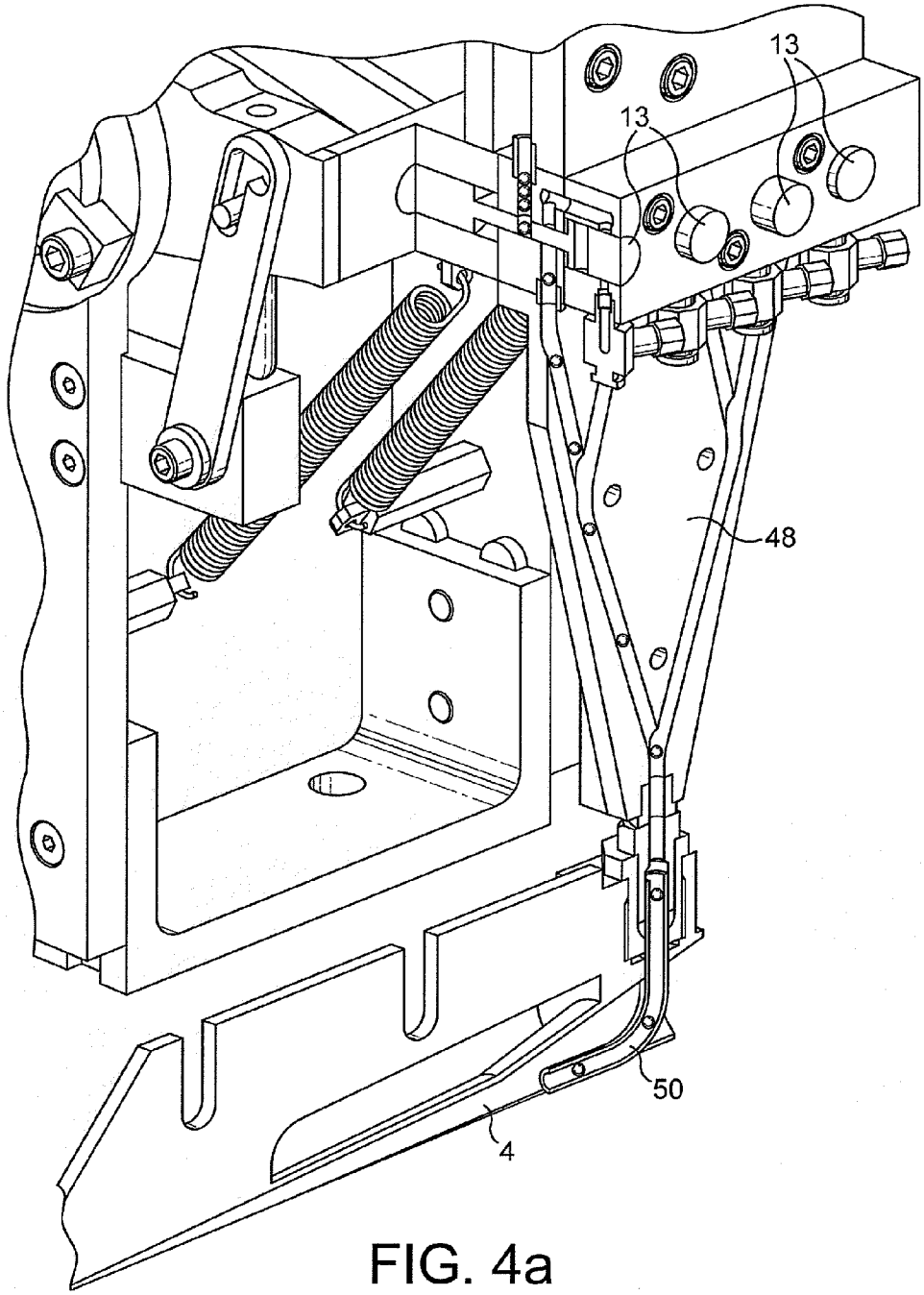

FIG. 4*a* is a more detailed view of the apparatus shown in FIG. 4, and illustrates the path of capsules through the capsule insert mechanism and into the tow.

Figure 5:
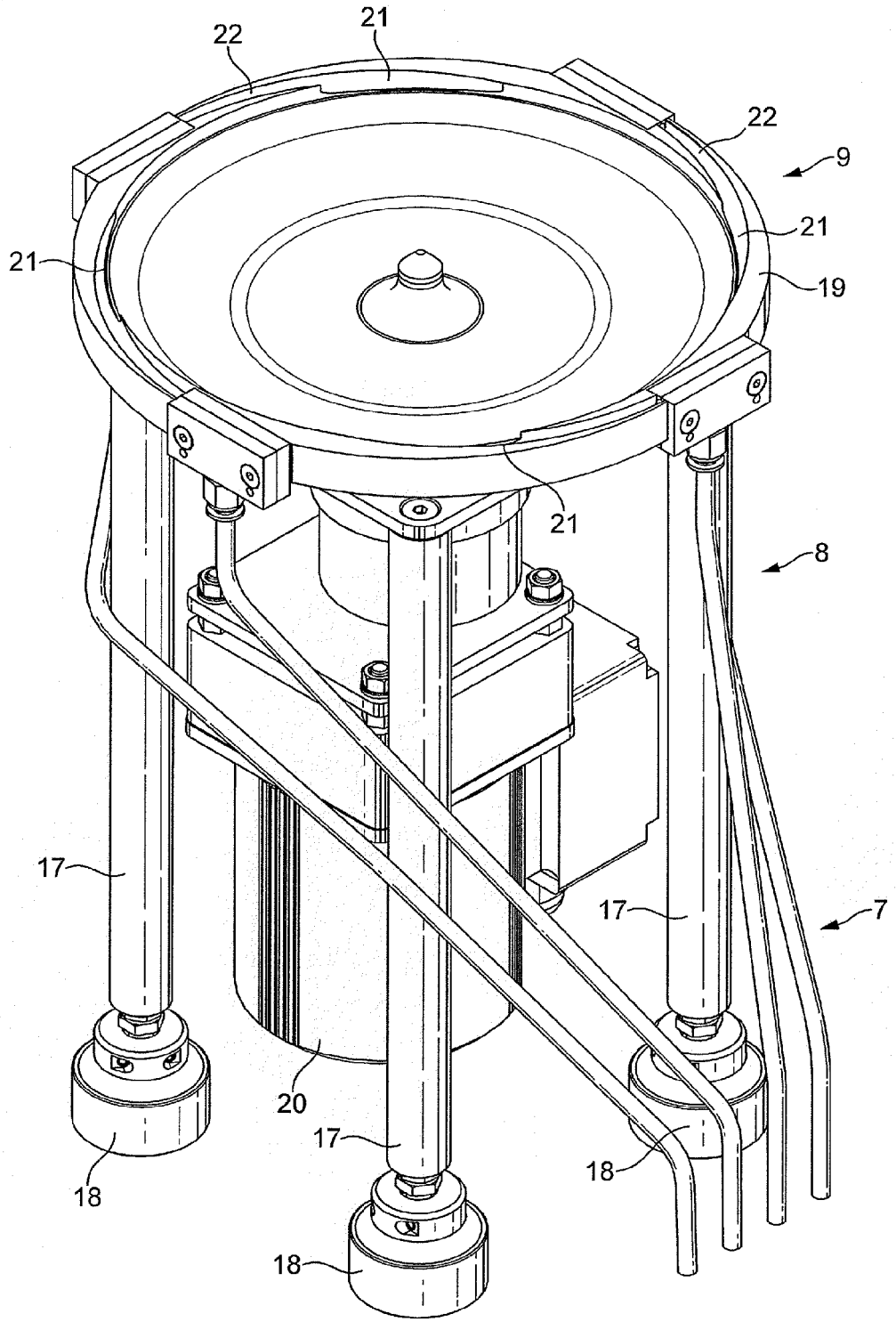

FIG. 5 is a more detailed perspective view of the feed unit.

Figure 6:
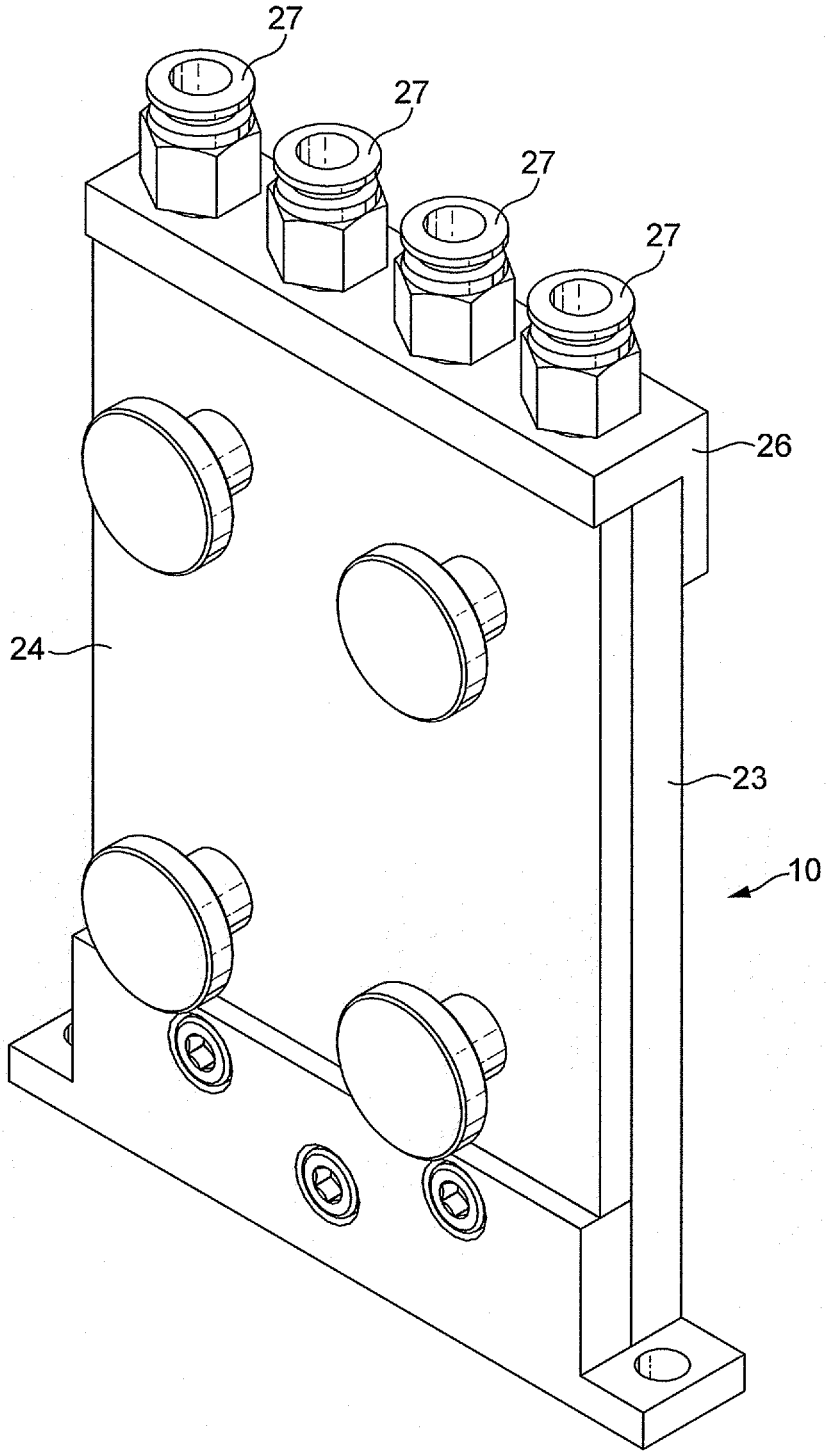

FIG. 6 is a more detailed perspective view of the hopper.

Figure 7:
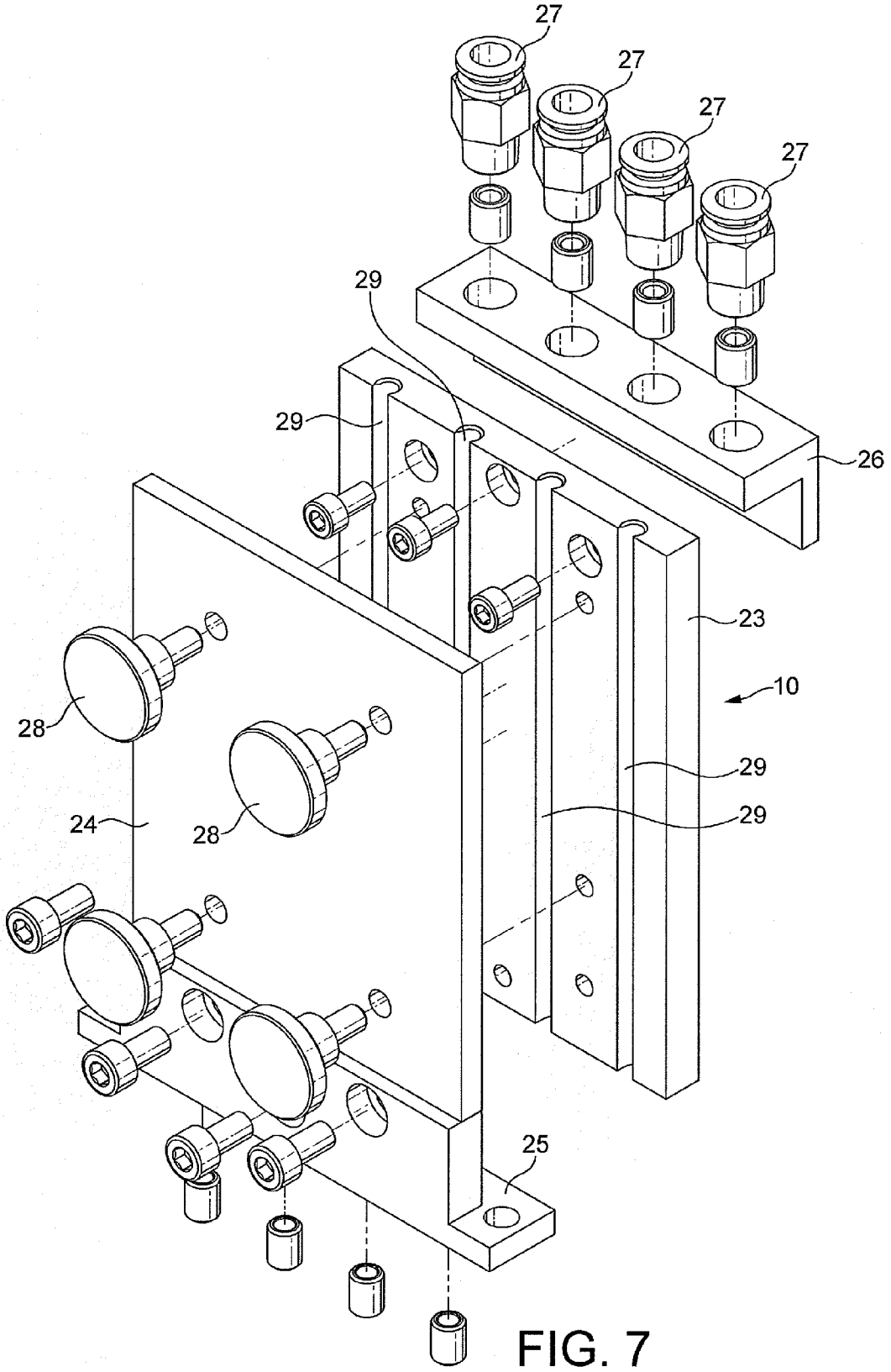

FIG. 7 is an exploded perspective view of the hopper.

Figure 8:
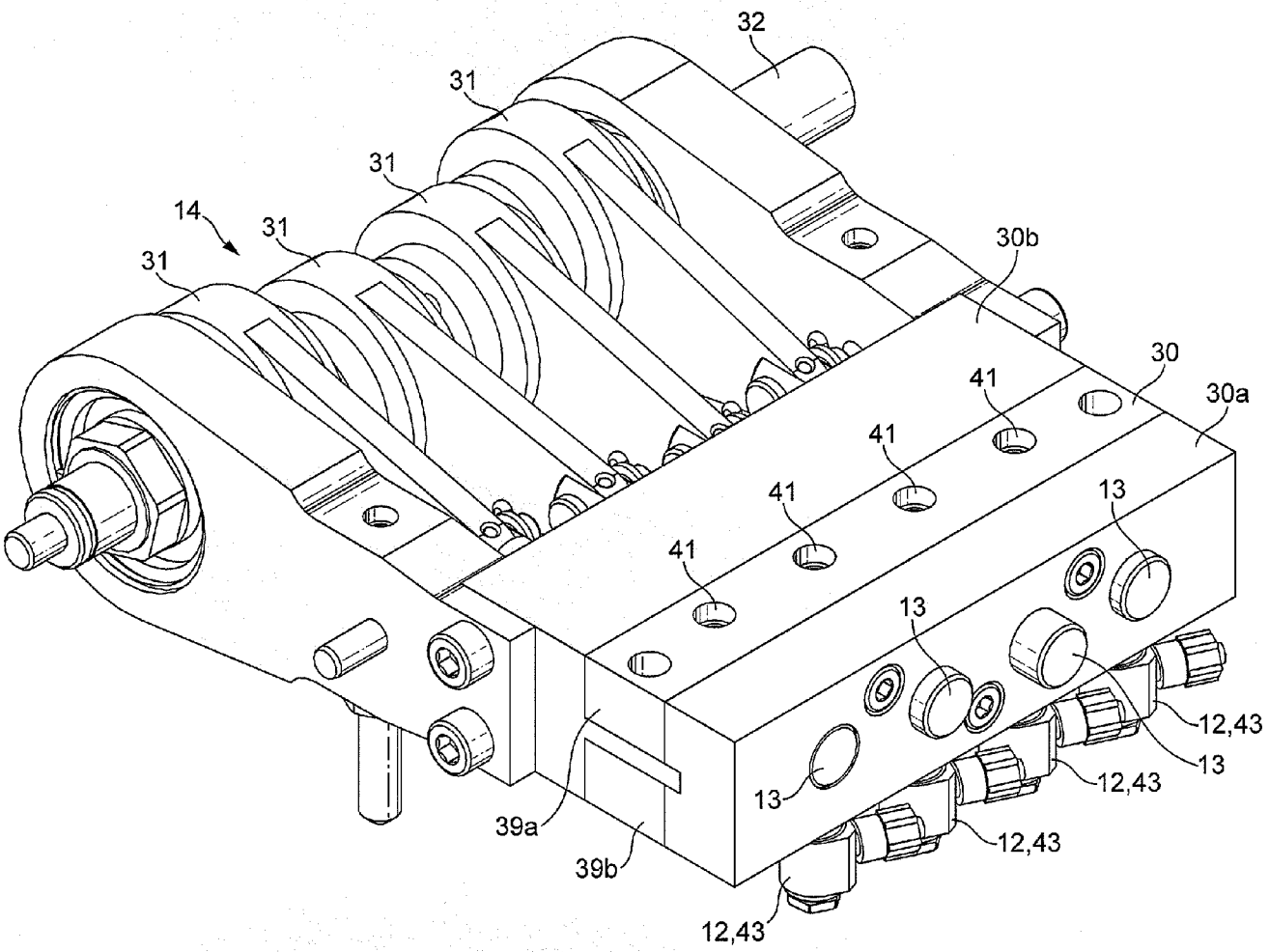

FIG. 8 is a perspective view of the transfer mechanism.

Figure 9:
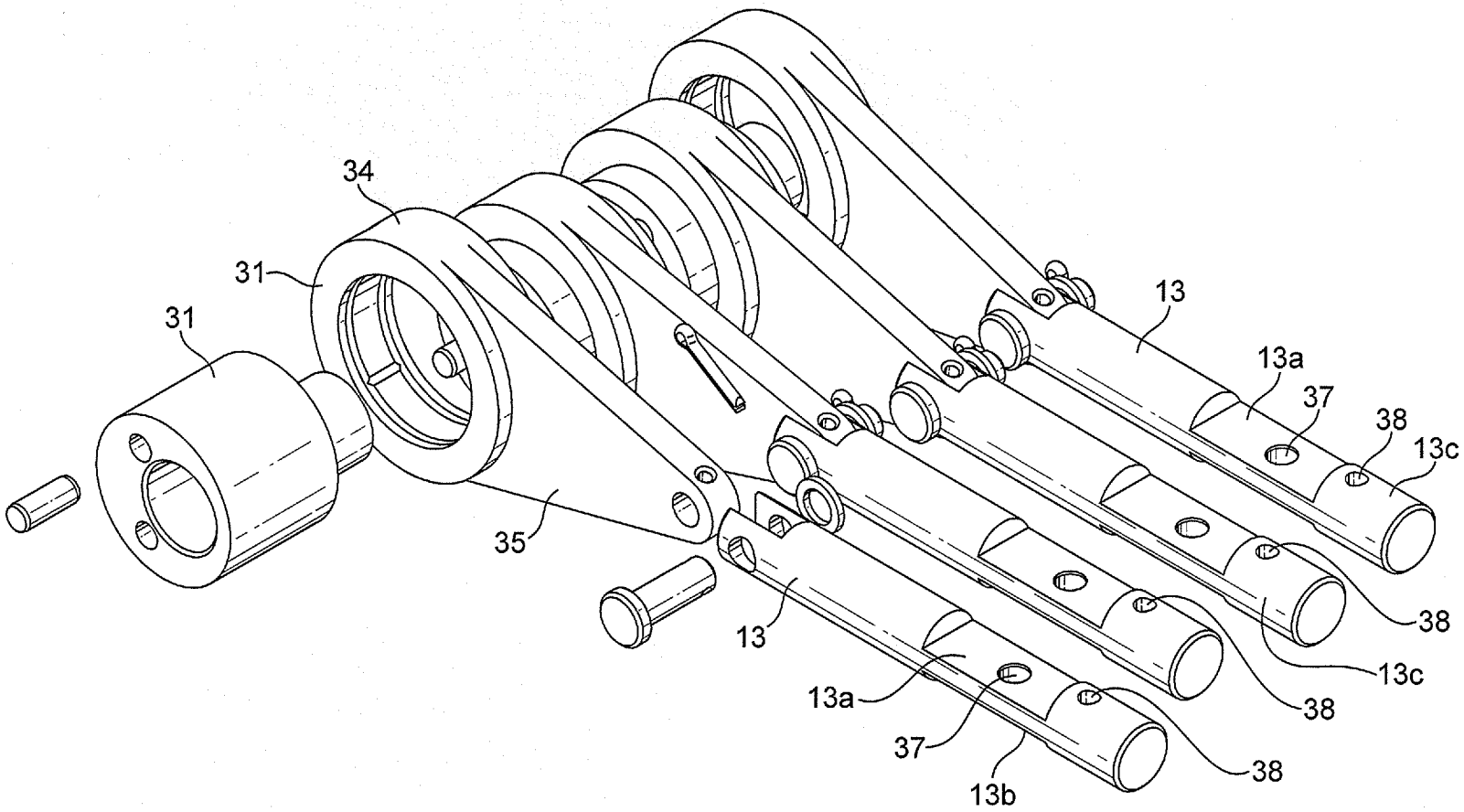

FIG. 9 is a perspective view of the eccentric mechanism and reciprocating rods of the transfer mechanism.

Figure 10:
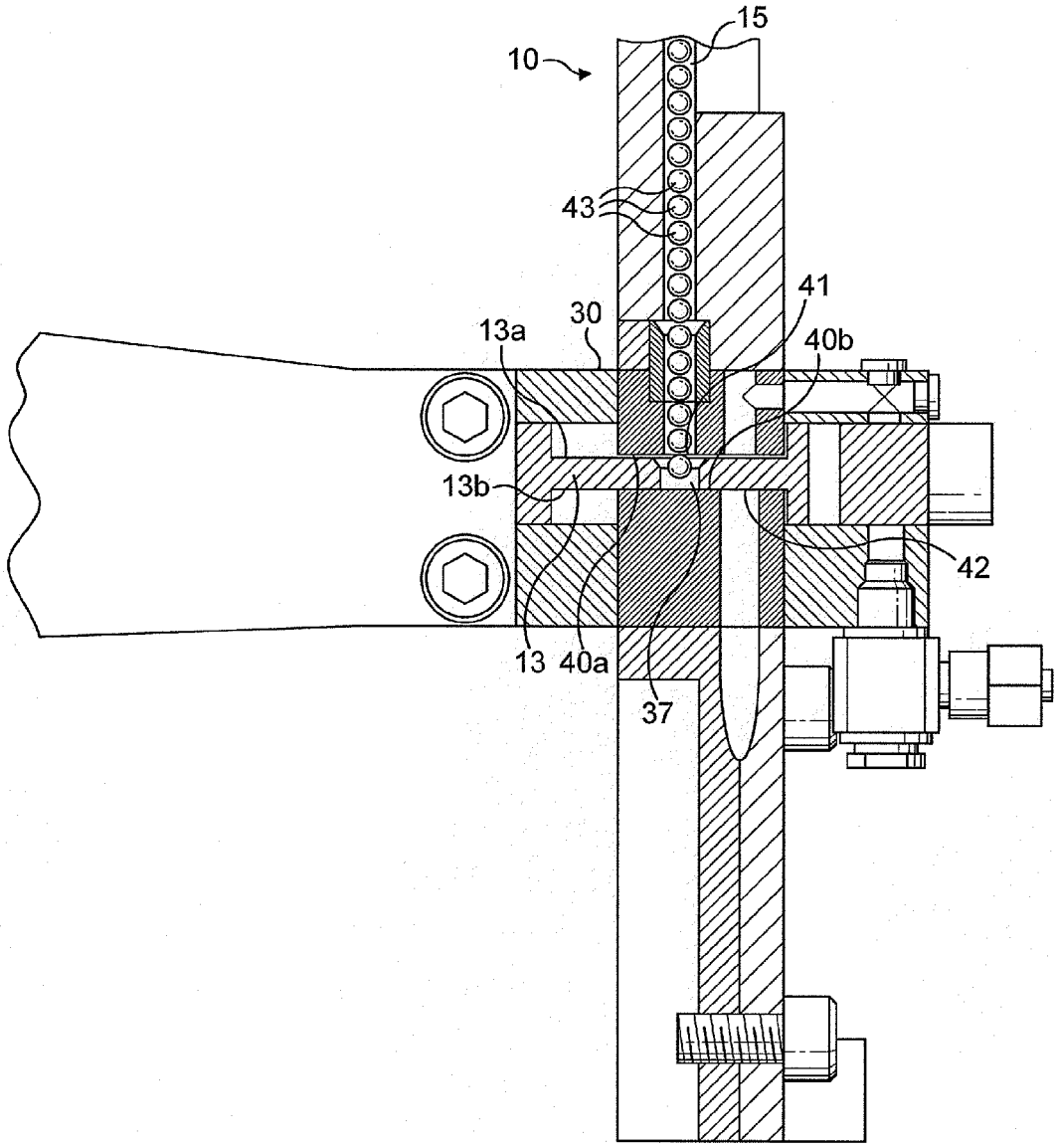

FIG. 10 is a side sectional view of the capsule insert mechanism and shows one of the reciprocating rods in a load position.

Figure 11:
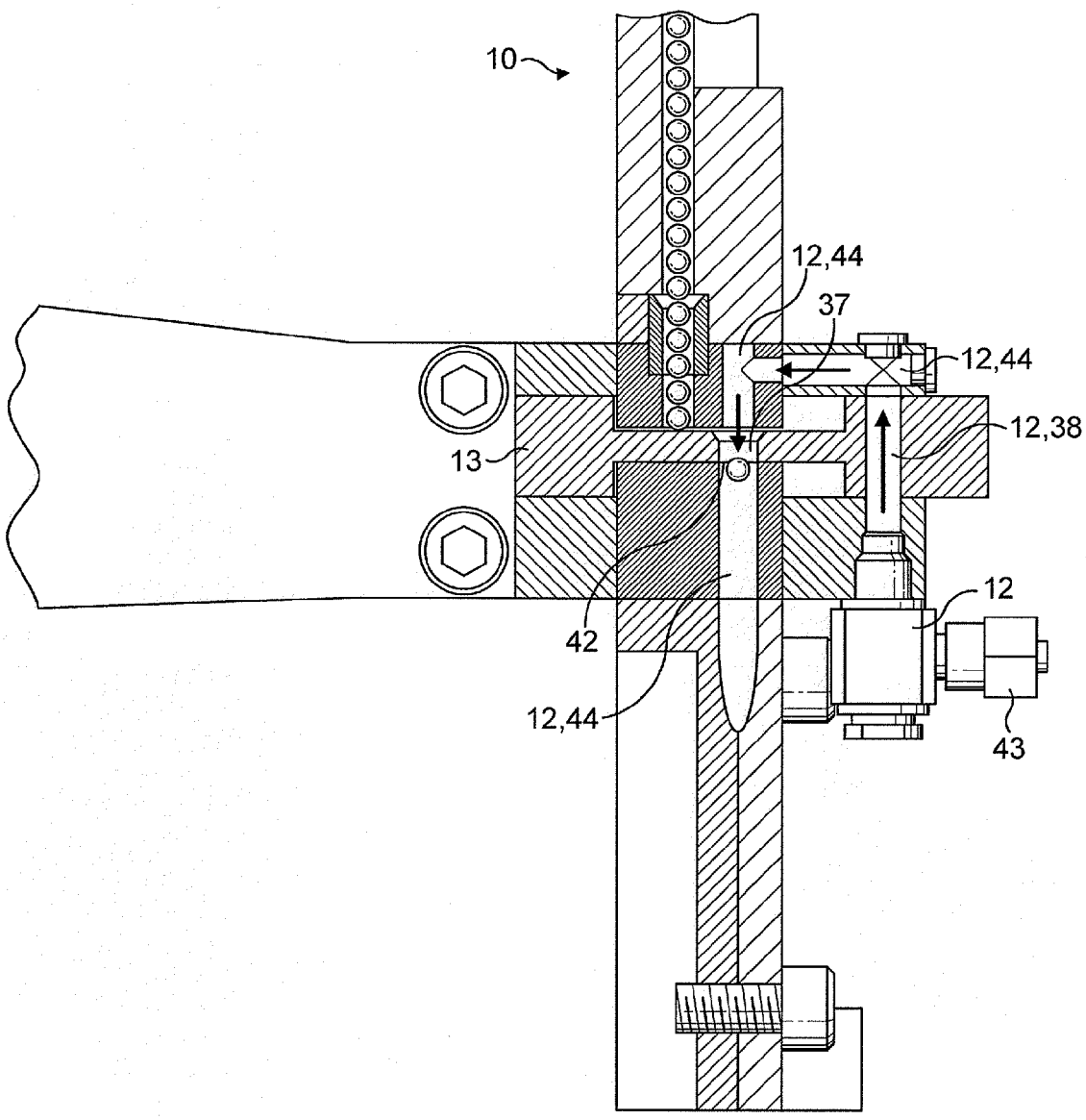

FIG. 11 is side sectional view of the capsule insert mechanism and shows one of the reciprocating rods in an eject position.

Figure 12:
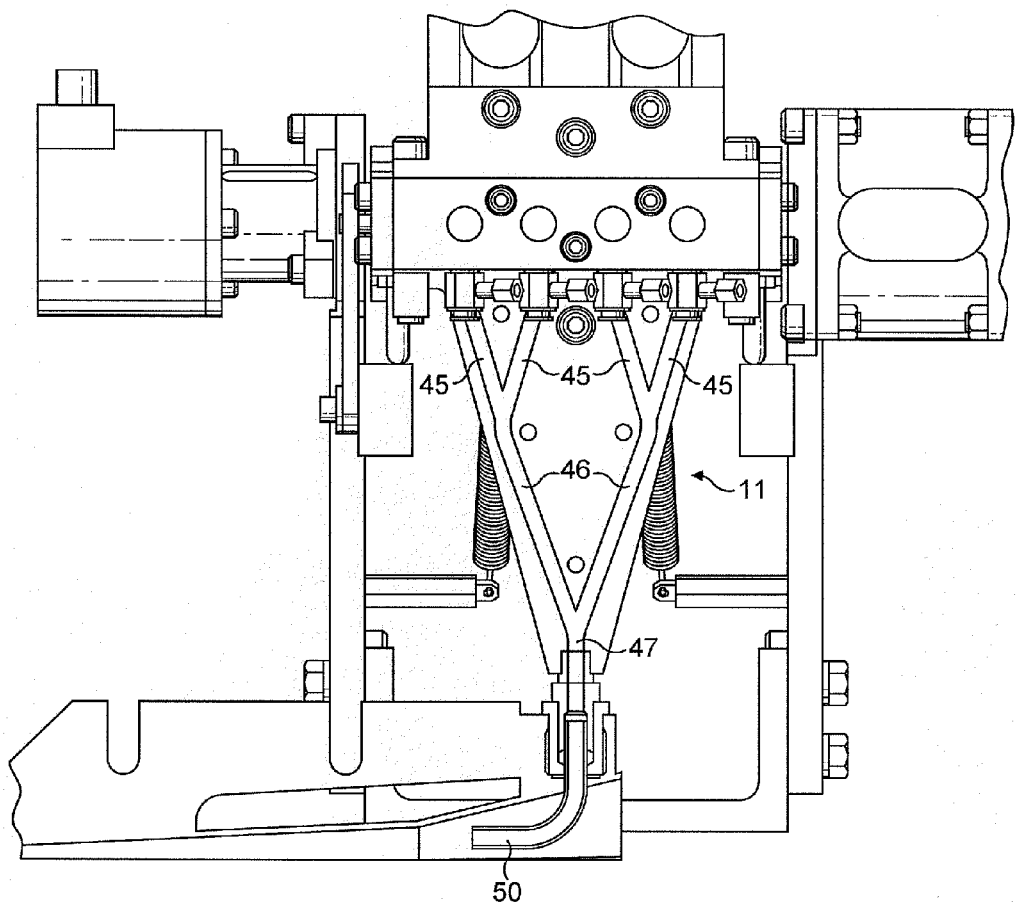

FIG. 12 is a front sectional view of the manifold assembly of the capsule insert mechanism. A side sectional view of the tongue is also illustrated.

Figure 13:
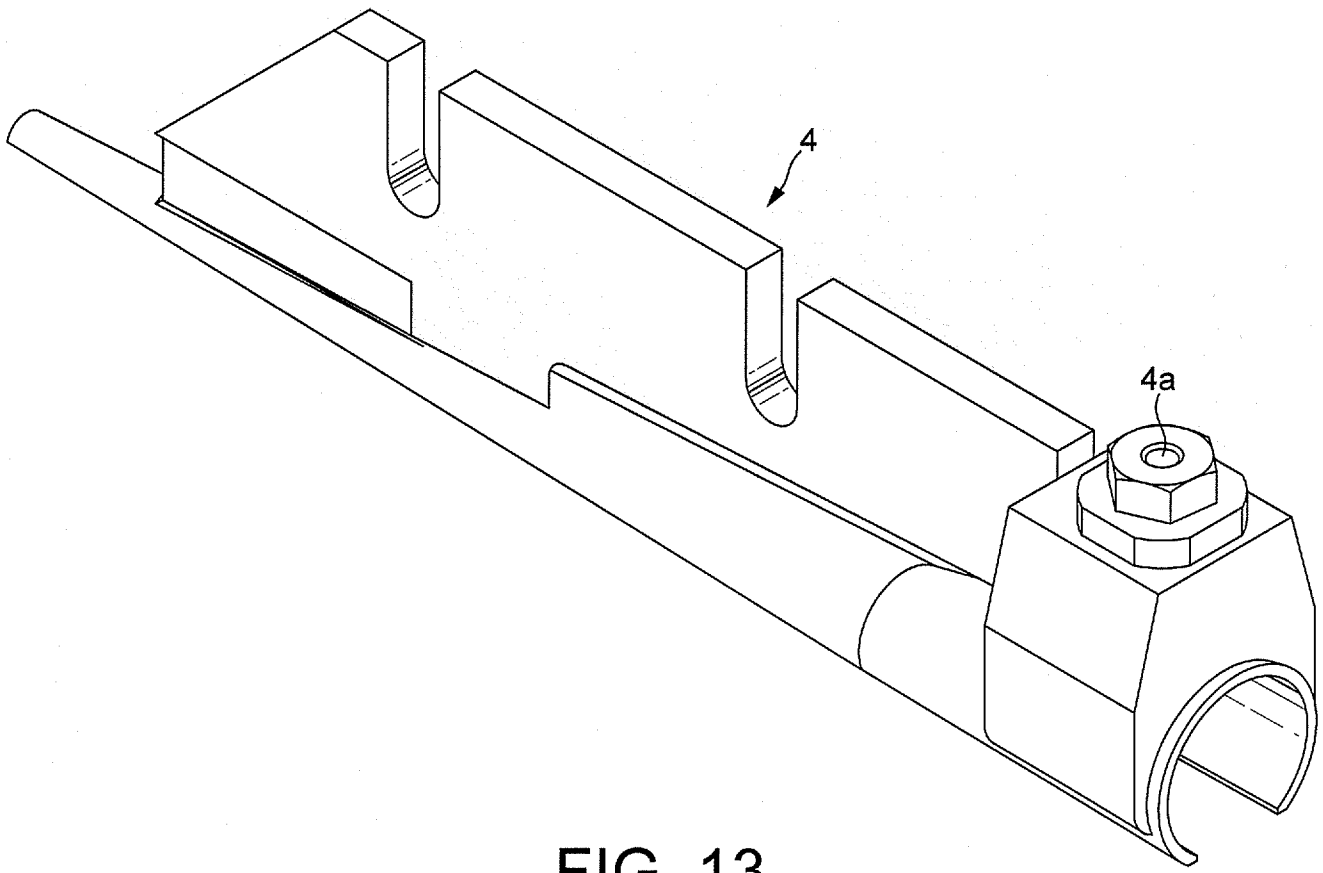

FIG. 13 is a perspective view of the tongue of the garniture of the filter making machine.

Figure 14:
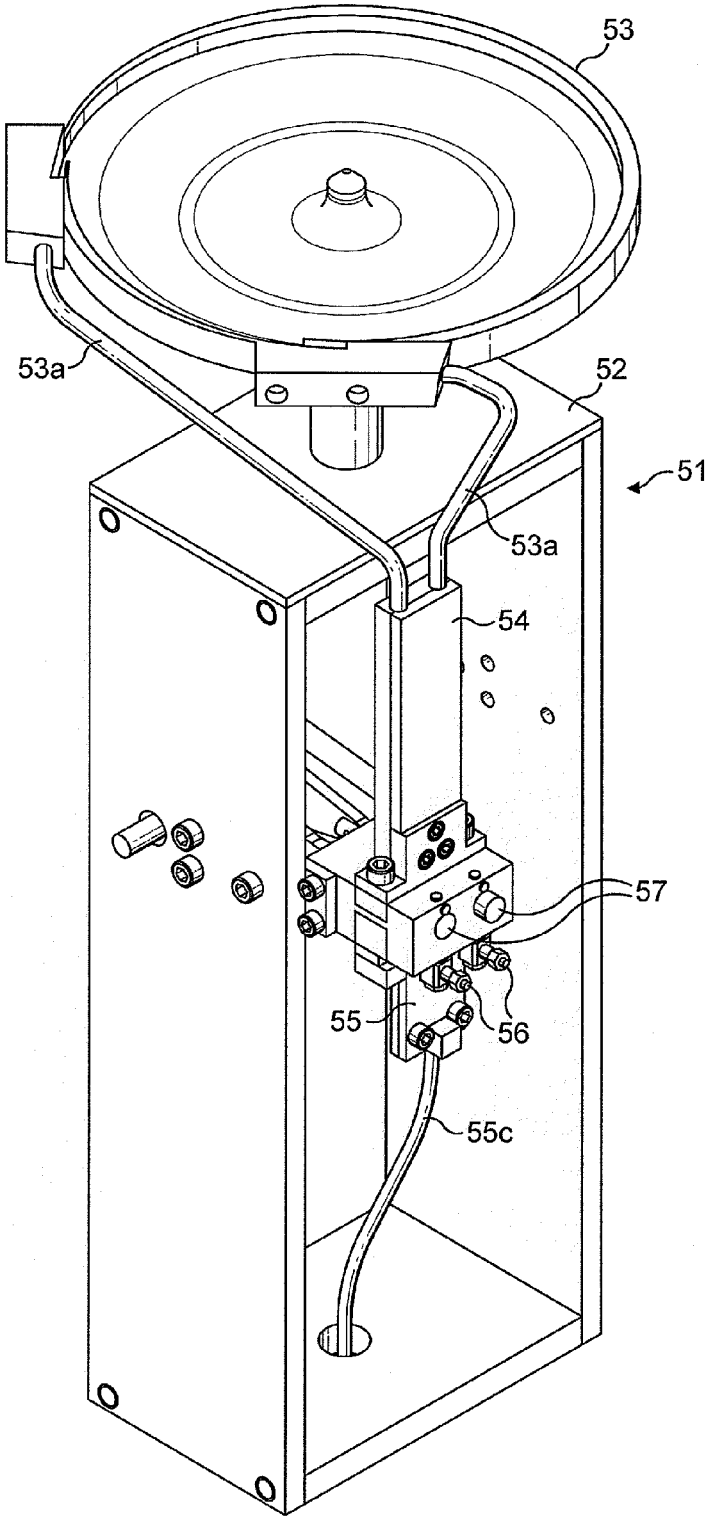

FIG. 14 is a perspective view of another capsule insert mechanism

Figure 15:
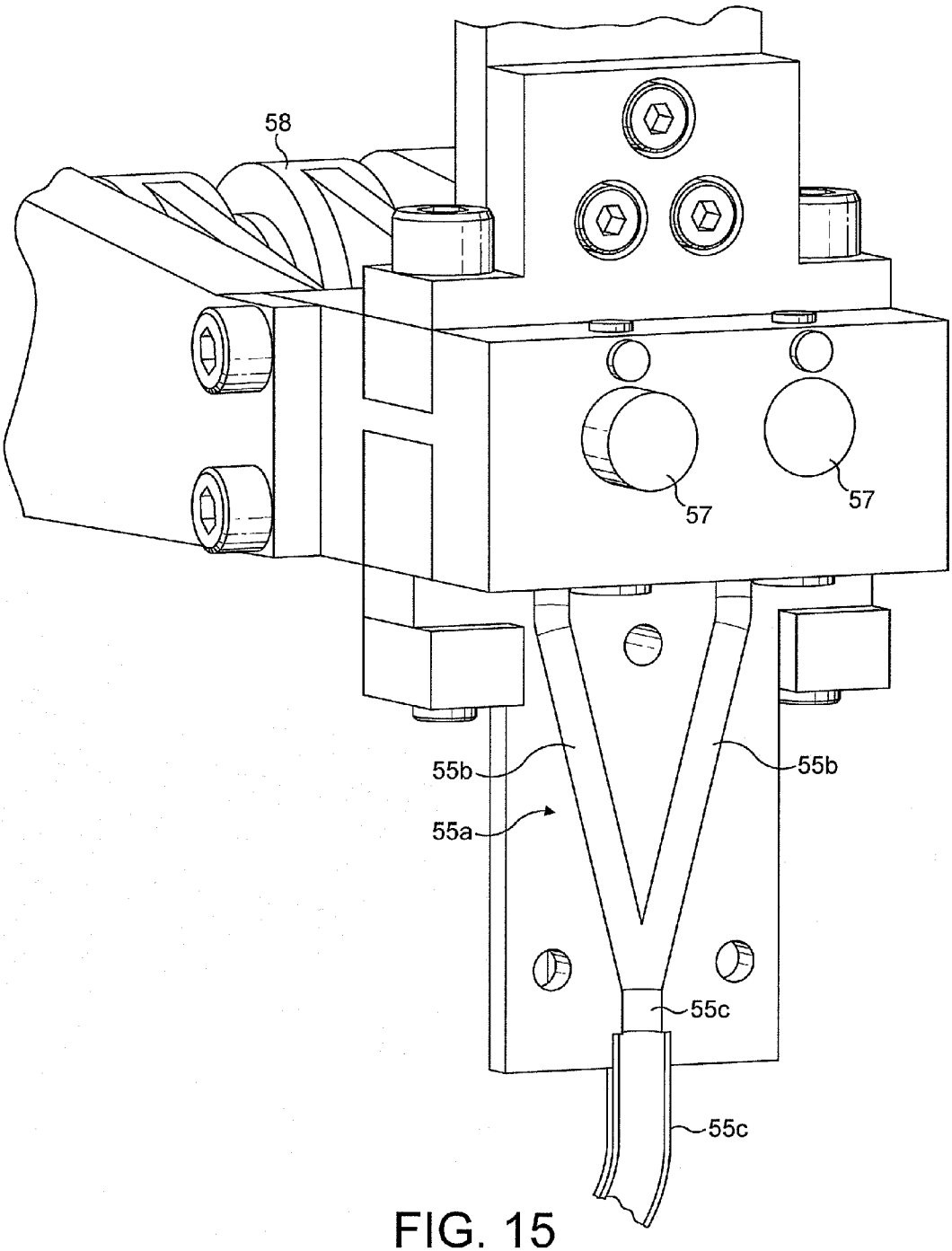

FIG. 15 is a more detailed perspective view of the transfer mechanism and manifold assembly of the capsule insert mechanism of FIG. 14, and shows a sectional view of the manifold assembly.

Figure 16:
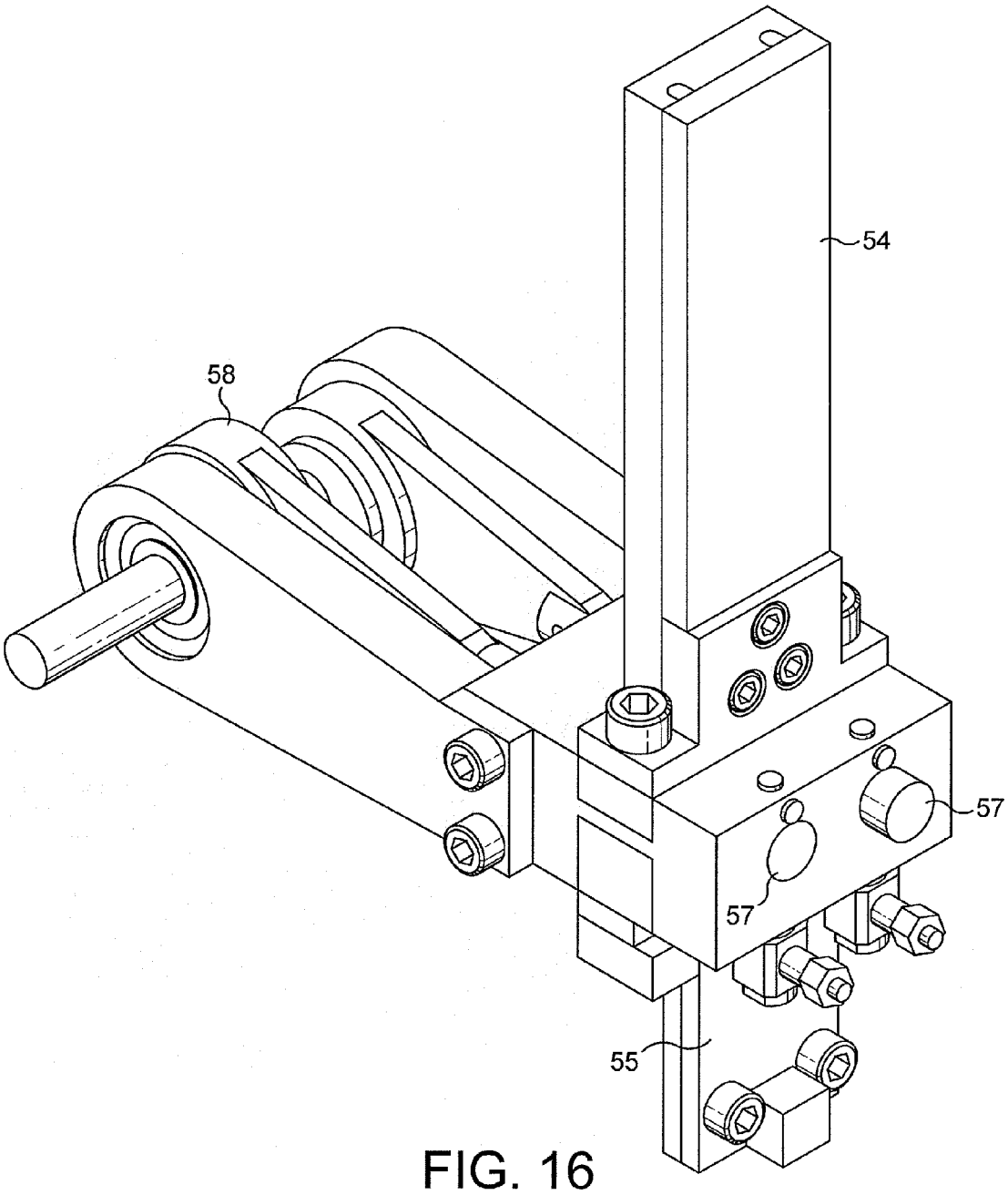

FIG. 16 is a more detailed perspective view of the hopper, transfer mechanism, rod driving mechanism and manifold assembly of the capsule insert mechanism of FIG. 14.

Figure 17:
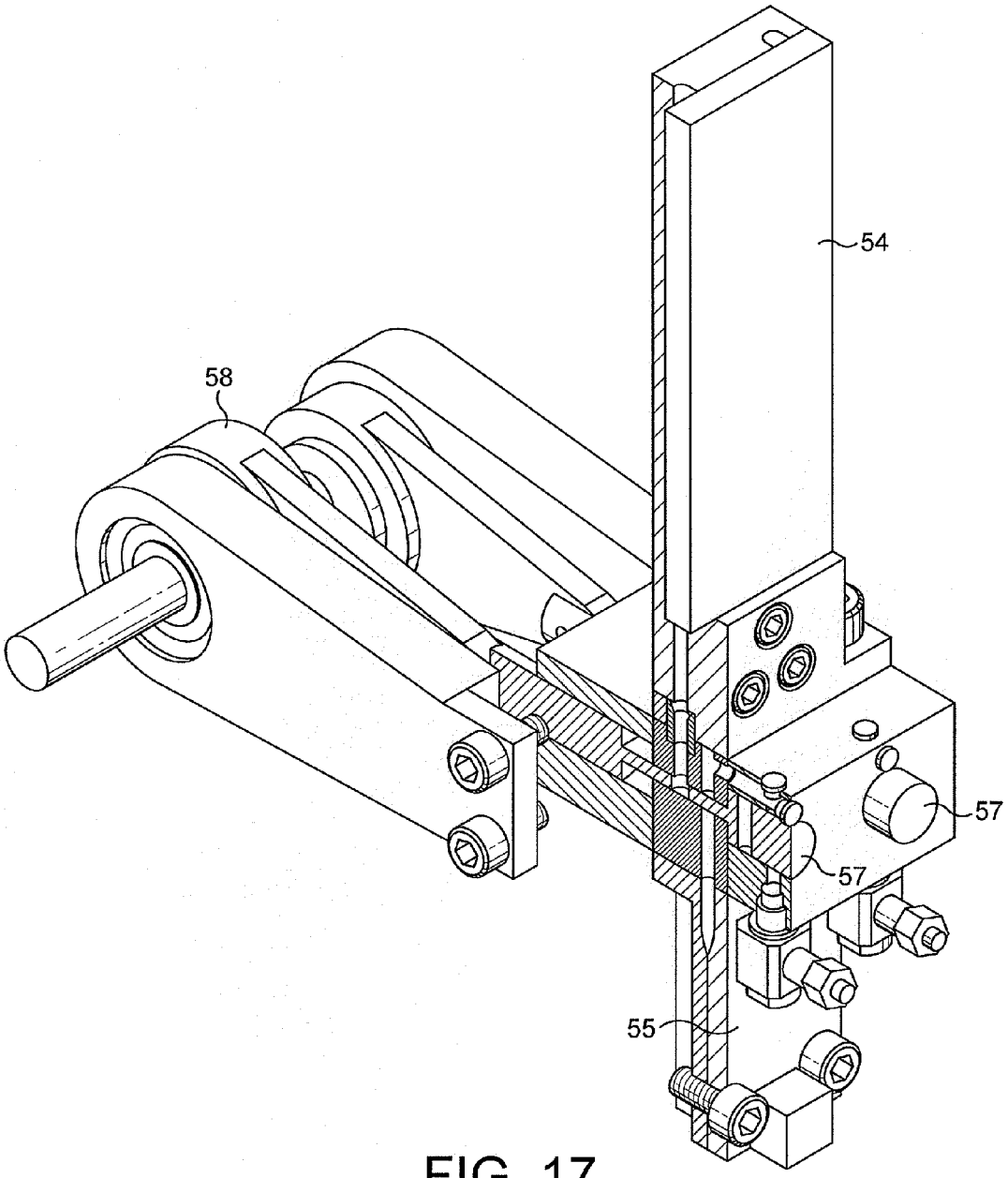

FIG. 17 is a perspective view of the capsule insert mechanism of FIG. 14 and shows a sectional view of the hopper, transfer mechanism and manifold assembly of the capsule insert mechanism of FIG. 14.

Figure 18:
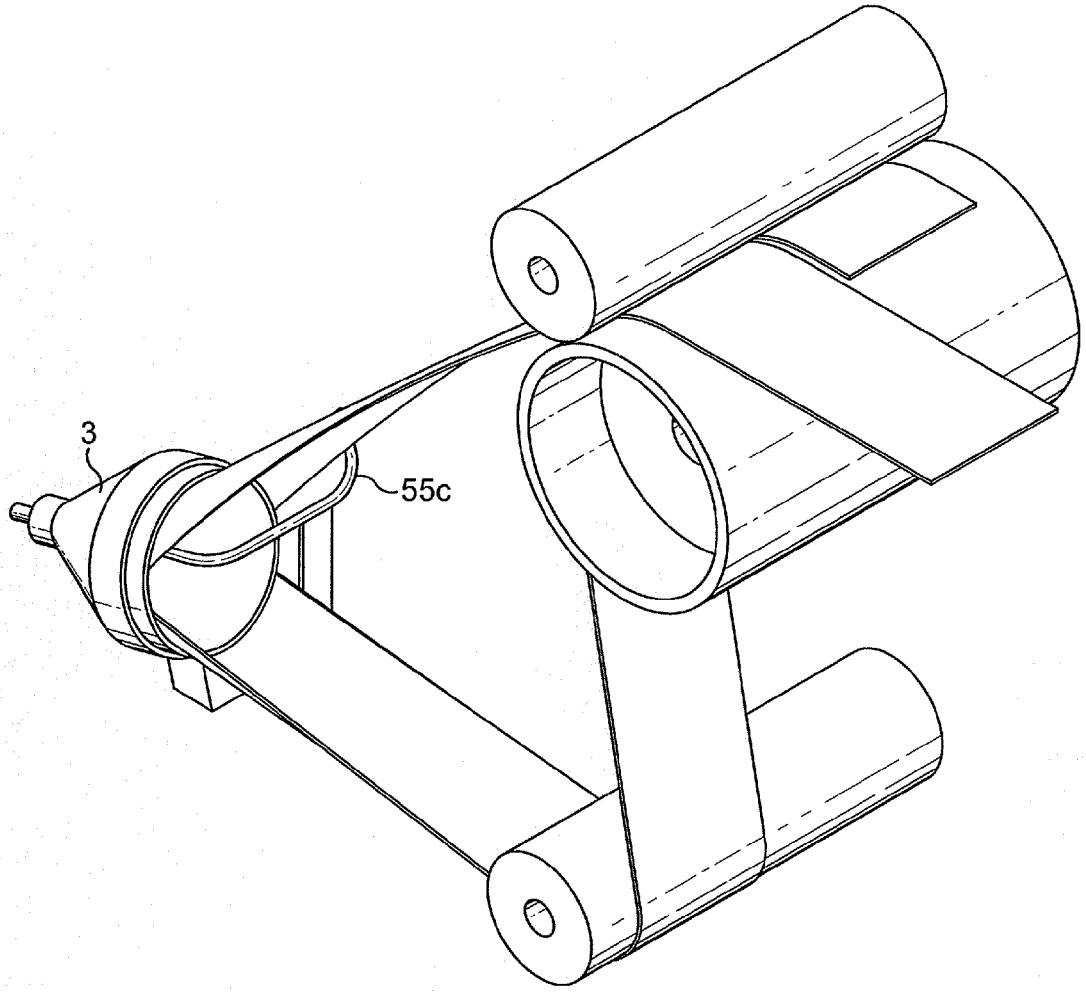

FIG. 18 illustrates delivery of capsules into a flow of tow via a tube inserted into the stuffer jet of a filter making machine.

FIGS. 19A-19D is a sectional view showing the sequential operation of a part of yet another capsule insert mechanism.

Figure 20:
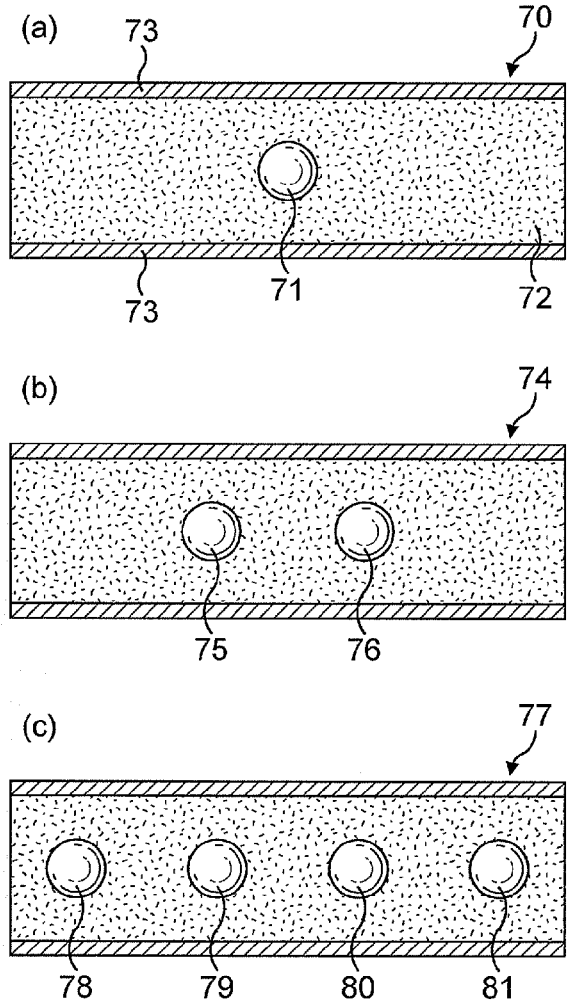

FIG. 20 shows examples of filter rods which may be manufactured by the machines described herein.

Figure 21:
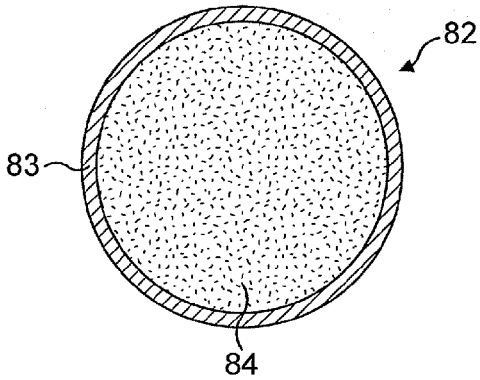

FIG. 21 shows a frangible gelatin capsule having a flavourant therein.

Figure 1:
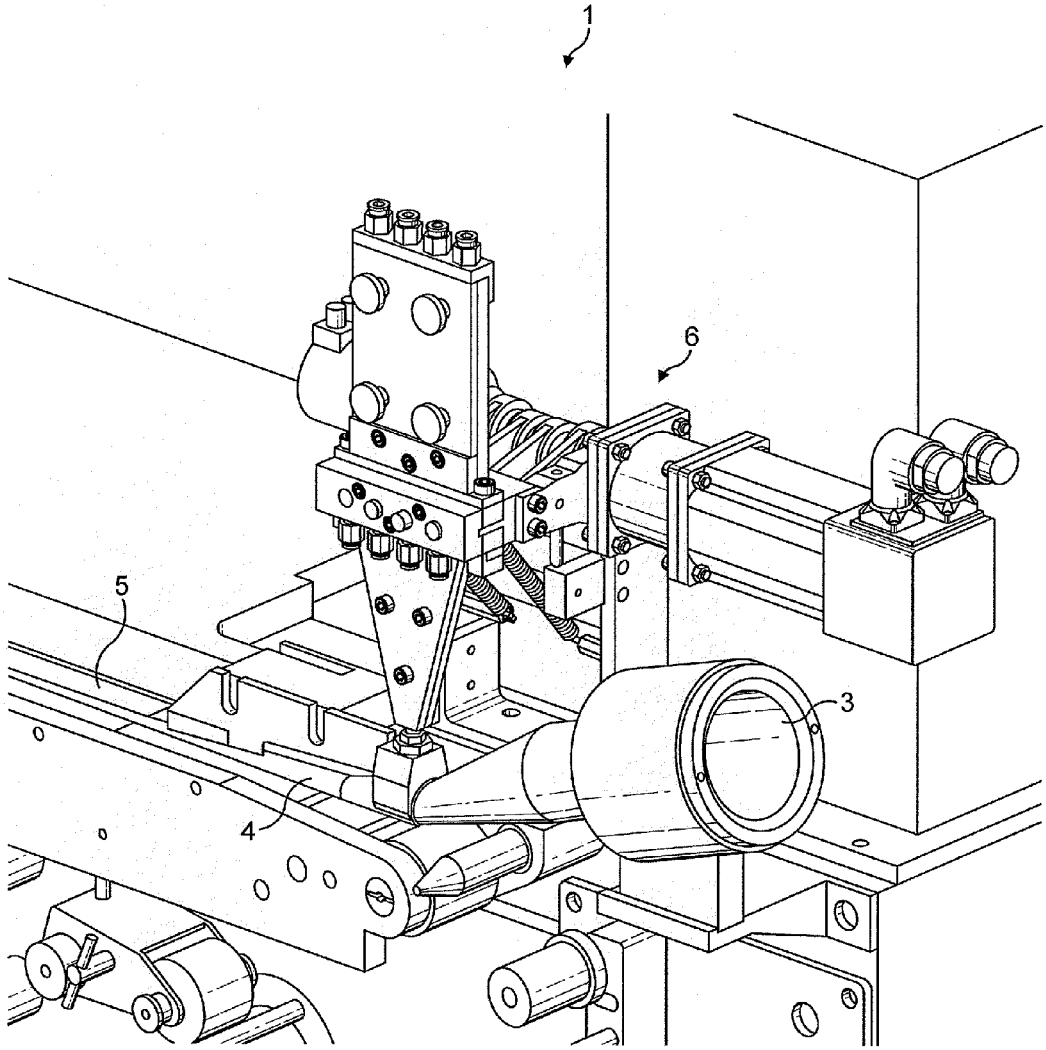
FIG. 1 is a perspective view of a part of a filter rod making machine, the filter rod making machine having a capsule insert mechanism.

FIG. 1 shows part of a filter rod making machine 1. During operation of machine 1, filter rod material in the form of cellulose acetate tow is drawn from a source of tow (not shown) through a set of conveying rollers (not shown), and is compressed through stuffer jet 3 and through the tongue 4 of a garniture 5, where it is paper wrapped with a plugwrap (not shown) and subsequently cut into segments by a cutter (not shown) to form filter rods.

As shown in FIG. 1, filter rod making machine 1 includes a capsule insert mechanism 6 for inserting one or more frangible, fluid-containing capsules into each eventual filter rod produced by the machine 1.

Referring to FIGS. 2 and 2*a*, capsule insert mechanism 6 is connectable via tubing 7 to a capsule reservoir in the form of a feed unit 8 having a rotatable dish 9. Prior to, or during operation of the machine 1, capsules are loaded into the dish 9. In use, the dish 9 is rotated by a motor. Thus, centrifugal forces are exerted on the capsules which urges them towards the outer edge of dish 9, where they are received into and through the tubing 7 and into the insert mechanism 6.

FIGS. 3, 3*a*, 3*b* and 4 show the insert mechanism 6 in more detail. As shown insert mechanism 6 comprises a temporary object store in the form of a hopper 10, a combining member in the form of a manifold assembly 11, a capsule propulsion mechanism 12 and a capsule transfer mechanism comprising four transfer members in the form of reciprocating rods 13 which are driven by a rod driving mechanism 14.

In use, capsules are fed from feed unit 8 into vertical channels 15 in the hopper 10, where they are temporarily stored until being successively received into recesses in the reciprocating rods 13 and transported by the movement of the rods towards the manifold assembly 11.

The capsules are then successively propelled by capsule propulsion mechanism 12 from the rods 13 into manifold assembly 11, where they are combined into a single output tube. The capsules then pass through a tube entering a hole 4*a* in the tongue 4 of the garniture 5 and into the moving tow. The capsules are then carried by the tow through the garniture and in this way are incorporated into the eventual filter rods.

The capsules are output from the reciprocating rods in an ordered sequence, for example one by one at fixed intervals. In this way, the capsules are introduced into the tow in a controlled manner so that a desired number of capsules are inserted into each filter rod produced by the machine 1. For example, the rate of introduction of capsules into the tow may be such that 1, 2 or 4 capsules are inserted into each filter rod.

FIG. 5 shows the feed unit 8 in more detail. As shown, the feed unit 8 is supported by legs 17 and feet 18 and has a rim 19. Feed unit 8 includes a motor 20, for example a 40 W, 135 RPM motor, which is coupled to the dish 9 by a shaft, and a gearing mechanism (not shown) configured to rotate the dish 9 so that the capsules are centrifugally urged towards the rim 19. As shown, the rim 19 has four openings 21 around its inner perimeter which receive capsules from the rotating capsule pool in the dish 9. The openings 21 lead to four arcuate grooves 22 which guide the capsules into the tubing 7, where they fall under gravity into the hopper 10.

Preferably, the machine 1 includes a load unit (not shown) mounted on top of the dish 9, for automatically loading capsules into the feed unit 8. The load unit comprises a capsule-containing area and a capsule detection mechanism having a photosensor for optically detecting whether the feed unit is loaded to capacity or not. The load unit is configured to load capsules from the capsule-containing area to the dish 9 if the dish 9 is not loaded to capacity. If the dish is loaded to capacity, the load unit does not load capsules into the dish. Thus, the load unit is configured such that the dish 9 is kept filled with capsules, but not overloaded. In this way, as capsules leave the dish 9 and pass into the tubing, further capsules are added to the dish 9 by the load unit so that the amount of capsules in the dish 9 is kept at a desired level.

Alternatively, however, prior to, or during operation of the machine 1, capsules may be manually loaded into the dish 9.

FIGS. 6 and 7 show the hopper 10 in more detail. As shown, the hopper 10 has a back plate 23, a covering plate 24 having a supporting lip 25, a connector plate 26 and four ports, in the form of quick connectors 27, configured to receive the four tubes of the tubing 7. Referring to FIG. 7, quick connectors 27 are threaded into threaded holes in the connector plate 26 and the plates 23, 24, 26 are coupled together with thumb screws 28.

As shown in FIG. 7, back plate 23 has four grooves 29 extending longitudinally from top to bottom thereof and aligned with the threaded holes in the connector plate. The supporting lip 25 has four vertical cylindrical holes (not shown) aligned with the grooves 29. Thus, the quick connectors 27, the holes in the connector plate 26, the grooves 29 and the holes (not shown) in the supporting lip 25 are aligned and define the four channels 15 running longitudinally through the hopper 10.

Although the hopper 10 is described above as being connectable via tubing to a capsule reservoir in the form of a single feed unit 8, alternatively the capsule reservoir may comprise 2, 3, or 4 storage units such as the feed unit 8. That is, the hopper 10 may be connected to a plurality of separate feed units. For example, two of the quick connectors may be connected to a first feed unit and the other two quick connectors may be connected to a second feed unit. The first and second feed units may each have two openings, rather than the four openings 21 of the feed unit 8, each opening leading to a single tube which delivers capsules under gravity to one of the quick connectors 27 of the hopper 10. The first and second feed units may be loaded with capsules containing different fluids, for example different flavourants such as menthol, spearment or orange essence. Similarly, the hopper 10 may alternatively be connected to four separate feed units, each for instance containing a respective type of capsule.

FIGS. 8 to 11 shows the capsule transfer mechanism in more detail. As shown in FIG. 8, the capsule transfer mechanism comprises a housing 30 in which the reciprocating rods 13 are movably housed. The transfer mechanism further comprises a rod driving mechanism 14 configured to provide reciprocating horizontal motion to the rods 13 relative to the fixed housing 30.

Referring to FIGS. 8 and 9, rod driving mechanism 14 comprises four eccentric mechanisms 31, each eccentric mechanism being coupled to an axle 32 which in use is rotated by a motor 33. As shown, each eccentric mechanism has a circular collar 34 attached to a protruding part 35 which in turn is attached to a rod 13. In this way, the rod driving mechanism is configured such that rotation of the axle 32 by the motor 33 imparts reciprocating motion to the rods 13. Thus, the rate of rotation of the axle 32 controls the rate at which the rods 13 move back and forth.

Referring to FIGS. 9, 10 and 11 the reciprocating rods 13 have cut-away sections which define vertically aligned flat regions 13*a*, 13*b* on either side of each rod. As shown, a recess in the form of a vertical cylindrical hole 37 is formed from the upper flat region 13*a* to the lower flat region 13*b* of each rod 13.

Preferably the hole 37 is dimensioned so as to have capacity for only one capsule at any one time. However, the hole 37 may be dimensioned so as to have capacity for two, three or more capsules at any one time.

As shown, an air channel 38 in the form of further vertical cylindrical hole is formed through the cylindrical end part 13*c* of each rod 13. The air channel 38 forms part of the capsule propulsion mechanism described in more detail below.

As shown in FIGS. 8 to 10 the housing 30 has front and rear body parts 30*a*, 30*b* and top and bottom inserts 39*a*, 39*b*. The front and rear body parts 30*a*, 30*b* have cylindrical holes therethrough to slidably accommodate the front and end parts of the rods 13. As shown in FIGS. 10 and 11, in use the rods 13 move horizontally back and forth within the housing 30 and the flat regions 13*a*, 13*b* of the reciprocating rods 13 slide between the flat interior surfaces 40*a*, 40*b* of the inserts 39*a*, 39*b*.

As shown in FIG. 8-10, the top insert 39*a* has four vertical cylindrical holes 41 arranged to receive capsules from the channels 15 of the hopper 10. The lower insert 39*b* has four vertical cylindrical holes 42, offset from the holes 41 along the direction of the rods 13 and arranged to receive capsules from the rods 13.

The action of one of the reciprocating rods 13 will now be described. FIGS. 10 and 11 show cross sectional views of the insert mechanism 6. As shown, a column of capsules 43, one on top of the other, is contained in channel 15 of hopper 10. In FIG. 10, rod 13 is positioned in a load position in which the hole 37 in the rod 13 is aligned with a hole 41 in the upper insert 39*a*. Thus as shown, a capsule 43 from the capsule column falls under gravity into the hole 37 and onto the surface 40*b* of the lower insert 39*b*. This causes the column of capsules 43 in the hopper 10 to move vertically downwards and makes a space at the top of the column for a further capsule to be received from the feed unit 8.

The rod 13 then moves away from the load position and thus transports the capsule in the hole 37 along the interior surface 40*b* of the bottom insert 39*b* until the rod 13 reaches the eject position shown in FIG. 11. As shown, in the eject position, hole 37 is aligned with a hole 42 in the bottom insert 39*b*. In this position, an airjet from capsule propulsion mechanism 12 propels the capsule 42 from the hole 37 through the hole 42 and into the manifold assembly 11. Once the capsule has been ejected, the driving mechanism moves the rod 13 back into the load position shown in FIG. 10 to receive the next capsule 43 from the column of capsules 43. The rod driving mechanism 14 is configured such that a full rotation of the axle 32 causes the rod 13 to move through the load and eject positions shown in FIGS. 10 and 11 respectively.

The foregoing description referred to the passage of capsules through one channel 15 of the hopper 10, into a recess in one of the rods 13 and into the manifold assembly 11. The same process applies in the same way to the other channels and rods shown in FIGS. 1-9.

The capsule propulsion mechanism 12 will now be described in more detail. As shown in FIGS. 8 to 11, capsule propulsion mechanism 12 comprises four quick connectors 43 for connection with cylinders of compressed air (not shown) and a series of air channels 38, 44. Air channels 44 are formed in the front and rear body parts 30*a*, 30*b* and the top insert 39*a* of the housing 30. Air channel 38 formed in the end part 13*c* of each rod 13. The air channels 38, 44 are configured such that when a rod is in the eject position, the air path from the corresponding quick connector 43 to the manifold assembly 11 is completed, thereby providing a pulse of air to blow the capsule into the output manifold 11.

Referring to FIG. 10, when rod 13 is the load position, the air path from quick connector 43 to the output manifold 11 is blocked by the rod 13. As shown, the air path is blocked by the end part 13*c* of rod 13 and is further blocked by the flat region of rod 13. Thus, in the load position no air is drawn from the air cylinder attached to quick connector 43. However, as shown in FIG. 11, when rod 13 is in the eject position, air from the cylinder may flow through channels 44, via channel 38 in rod 13 and through hole 37 in the rod and into the output manifold 11. Thus, a jet of air is drawn from the air cylinder. In this way, air pulses drawn from the air cylinders are automatically synchronised with the motion of the reciprocating rods. That is, when each rod moves into the eject position, a pulse of air is automatically supplied from the corresponding cylinder. However, when the rod is away from the load position, no air is supplied. Thus, compressed air is only supplied when it is needed.

It will be understood by those skilled in the art that the downward force of gravity may assist in transferring capsules into the output manifold 11 in addition to the action of the capsule propulsion mechanism 12. Alternatively, no propulsion mechanism may be employed and the capsules may drop into the output manifold 11 through the action of gravity alone.

Furthermore, propulsion means other than air may be used to propel the capsule into the outlet. Examples can include (but are not limited to) any compressed gas or liquid.

The rod driving mechanism 14 is configured such that the motion of the rods 13 is staggered relative to one another. Thus, only one of the rods 13 receives a capsule at any one time. In addition, the output manifold 11 receives a capsule from only one of the rods 13 at any one time.

Thus, receiving capsules into the rods comprises: receiving a first capsule into a first of the rods, then receiving a second capsule into a second of the rods, then receiving a third capsule into a third of the rods; then receiving a fourth capsule into a fourth of the rods.

Further, receiving capsules into the output manifold comprises: receiving a first capsule from a first of the rods, then receiving a second capsule from a second of the rods, then receiving a third capsule from a third of the rods; then receiving a fourth capsules from a fourth of the rods.

The coordination of the movement of the respective reciprocating rods ensures that capsules are ejected one at a time from each of the rods 13 into the output manifold 11 and thus one at a time into the tow. The configuration is beneficial as it allows for a high rate of capsule transfer, by virtue of the use of more than one transfer unit, and thus a short separation between the capsules in the eventual rod, whilst ensuring that there is a free flow of capsules into and through the output manifold.

FIG. 12 shows a sectional view of output manifold 11. As shown, output manifold assembly 11 comprises four capsule receiving tubes 45, one for each transfer unit. The tubes 45 may be formed by channels formed in the body of the output manifold 11, or may alternatively be, for example, plastic or rubber tubing housed inside the manifold 11. Each capsule receiving tube is arranged to receive capsules from only one of the rods 13. As shown, output manifold assembly further comprises two intermediate tubes 46 and an output tube 47. Each intermediate tube 46 is connected to two of the capsule receiving tubes 45 and to the output tube 47. Thus, capsules blown into the capsule receiving tube 45 are guided into the intermediate tube 46 and into the output tube 47. As shown in FIGS. 4 and 4*a*, the tubing 45, 46 and part of the output tube 47 is housed in a housing 48.

Preferably, one or more tubes (45, 46, 47) directly connect an output of a said reciprocating transfer unit to a point of insertion into the filter rod material. Tubes from an output of each transfer unit merge such that all capsules are output to the single point of insertion.

Preferably, the object store is configured to transfer objects to a reciprocating transfer unit in a direction transverse, i.e. having a component perpendicular, to an axis along which the reciprocating transfer unit reciprocates. Alternatively, or in addition, the apparatus is configured to output objects from a reciprocating transfer unit in a direction transverse, i.e. having a component perpendicular, to an axis along which the reciprocating transfer unit reciprocates. Preferably, the input and/or output directions are substantially perpendicular to the axis along which the reciprocating transfer unit reciprocates.

Preferably, the object propulsion mechanism (12) comprises a first port on a first side of the reciprocating transfer unit and a second port (42) on a second side of the reciprocating transfer unit. The second port is opposite the first port. The first and second ports are aligned with an object in a second, eject, position of the transfer unit. The object proportion mechanism is configured to propel fluid (e.g. air) through the first and second ports and the reciprocating transfer unit to propel the object.

Preferably, a hole (37) in the transfer unit inhibits movement of the object within the reciprocating transfer unit in both directions along an axis on which the reciprocating transfer unit is configured to reciprocate.

Referring to FIGS. 12 and 13, tongue 4 has a hole 4*a* for receiving capsules from the manifold assembly 11. As shown in FIG. 12, tongue 4 further comprises a curved guiding tube 50, which receives capsules from the output tube 47 and guides them into the center of the tow path.

Preferably the filter making machine manufactures "double length" filter rods suitable for manufacturing two cigarettes. As is well known in the art, in cigarette manufacture using such filter rods, each filter rod is longitudinally aligned with a pair of tobacco rods, wrapped with a tipping paper to join the rods to the filter and subsequently cut, thereby forming two cigarettes.

However, alternatively the filter rods manufactured by the machine may have any other length and may for example be "single length" filter rods suitable for attachment to a single tobacco rod with a tipping paper to form a cigarette. Alternatively, the filter rods may be triple or quadruple length filter rods. Alternatively, the filter rods manufactured by the filter making machine may be filter segments intended to form part of a multi-segment filter. Alternatively, the filter rods may be cut to form rod segments for use as part of multi-segment filters.

This machine 1 may be used to deliver capsules comprising two or more varieties of capsule from two or more separate feed units, e.g. one capsule variety containing menthol and one capsule variety containing spearmint or another flavourant such as orange essence. For example, a first variety of capsules may be loaded into a first feed unit connected by tubing to the insert mechanism 6 and a second variety of capsules may be loaded into a second feed unit, also connected by tubing to the insert unit 6. The reciprocating rods may be configured to alternately output capsules of the first and second varieties. The alternate output of the reciprocating rods may then be combined in the output manifold 11 so that capsules of the first and second varieties are alternately delivered into the tow and so that each eventual rod contains one capsule of the first variety and one capsule of the second variety, for example.

It will be apparent to those skilled in the art that variations of the insert mechanism 6 could insert any number of capsule varieties into the tow in any desired sequence. In this way, those skilled in the art will appreciate that variations of the filter rod machine 1 could be used to obtain filter rods containing any number of the same or different capsule varieties arranged in any desired sequence.

Furthermore, those skilled in the art will appreciate that the output sequence of the reciprocating rods may be tailored so that capsules are delivered into the tow with any desired period between successive capsule deliveries and that the delivery period may be the same or different between pairs of successive capsules.

For example, as described above receiving capsules into the output manifold may comprise: receiving a first capsule from a first of the rods, then receiving a second capsule from a second of the rods, then receiving a third capsule from a third of the rods; then receiving a fourth capsules from a fourth of the rods. The rod driving mechanism 6 of the machine 1 could be configured so that there is a short delivery period between the delivery of the first capsule and the second, subsequent capsule and a longer delivery period between the delivery of the third capsule and the fourth capsule.

In this way, those skilled in the art will appreciate that variations of the filter rod machine 1 could be used to obtain filter rods in which the neighbouring capsules in the rod are separated by any desired separation, and that this separation may be the same or different for different neighbouring capsule pairs.

Each filter rod made by the machine 1 is preferably generally identical. However, those skilled in the art will appreciate that the machine 1 may alternatively make filter rods of different varieties in a desired sequence. For example, a filter containing two capsules of one variety and a filter containing two capsules of another variety may be alternately manufactured.

FIGS. 14-17 shows another capsule insert unit 51, which is another variation of the capsule insert unit 6. As shown in FIG. 14, insert unit 51 comprises a frame 52 having a feed unit 53 mounted thereon. The insert unit further comprises a hopper 54, a combining member in the form of a manifold assembly 55, a capsule propulsion mechanism 56 and a capsule transfer mechanism comprising two transfer members in the form of two reciprocating rods 57 which are driven by a rod driving mechanism 58.

The feed unit 53 operates in substantially the same way as the feed unit 8 and differs in that the rim has two opening rather than the four opening 21 of the feed unit 8. Feed unit 53 feeds the hopper 54 through a pair of tubes 53*a*.

The hopper 54 is similar to the hopper 10 of the insert mechanism 6. However, the hopper 54 has only two channels rather than four. The channels receives capsules from the tubing 53*a* and in use, a column of capsules, one on top of the other is formed in each channel.

The transfer mechanism of the insert unit 51 operates in a similar manner to the transfer mechanism of the insert unit 6. However, the insert unit 51 has two reciprocating rods 57 rather than four. The reciprocating rods 57 operate in a similar manner to the rods 13. In use, reciprocating rods 57 alternately receive capsules into recesses therein and transfer the capsules towards the manifold assembly 55. Manifold assembly 55 has a Y-shaped tube 55*a* which alternately receives capsules from the rods 57. The Y-shaped tube 55*a* has first and second capsule receiving tubes in the form of first and second branches 55*b*, one for each transfer unit. As shown, each branch 55*b* is connected to an output tube part 55*c*, thus defining the "Y" shape. In use, capsules received into one or the other of the branches 55*a*, 55*b* are combined into a single stream in the output tube part 55*c* and subsequently guided into the flow of tow.

Although the capsules are described above as being delivered into the tongue 4 of the garniture 5, the capsules could alternatively be delivered into the tow in another way. For example, the output tube 55*c* may be inserted into the stuffer jet 3, as shown in FIG. 18. As shown in FIG. 18, the capsules are fed into the stuffer jet together with two bands of tow drawn via a set of rollers. Preferably, the output tube extends through the stuffer jet and into the tow inlet of the garniture tongue. The capsules are thus brought into contact with the tow in the tongue and are subsequently carried by the tow through the garniture so as to be incorporated into the eventual filter rods.

FIGS. 19A-D illustrates a further variation of the capsule insert units 6, 51. As shown, the reciprocating rod 59 of FIGS. 8A-D differs from the reciprocating rod 13, 57 in that the rod 59 comprises two capsule-containing recesses 60*a*, 60*b*. Furthermore, there are two separate capsule propulsion mechanisms for each rod 59, each capsule propulsion mechanism comprising channels 68*a*, 68*b* and a hole 69*a*, 69*b* in the rod 59. Furthermore, the manifold assembly comprises two capsule receiving tubes 61*a*, 61*b* for each rod 59, rather than one.

The purpose of the variation shown in FIGS. 19A-D is that there is no need to 'reset' the reciprocating rod after each delivery of a capsule. Instead, each movement of the reciprocating rod corresponds to the delivery of a capsule, i.e. the efficiency of the delivery unit is increased.

Figure 19A:
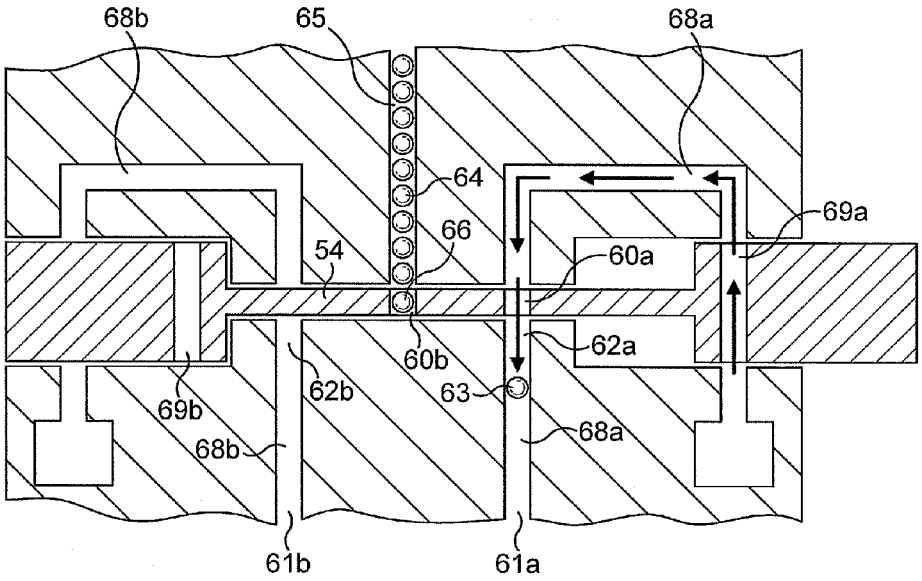

In FIG. 19A the right hand recess 60*a* of the reciprocating 59 rod is aligned with the mouth 62*a* of the right hand capsule receiving tube 61*a*. Further, the rod 59 is positioned such that a jet of air may pass through the channels 68*a*, 69*a* to propel a capsule 63 from the recess 60*a* into the tube 61*a*. As shown, path of air through the channels 68*b* is blocked by the rod 59. Further, as shown the left hand recess 60*b* is aligned with the column of capsules 64 in the channel 65 and a capsule 66 has dropped into the recess 60*b*

Figure 19B:
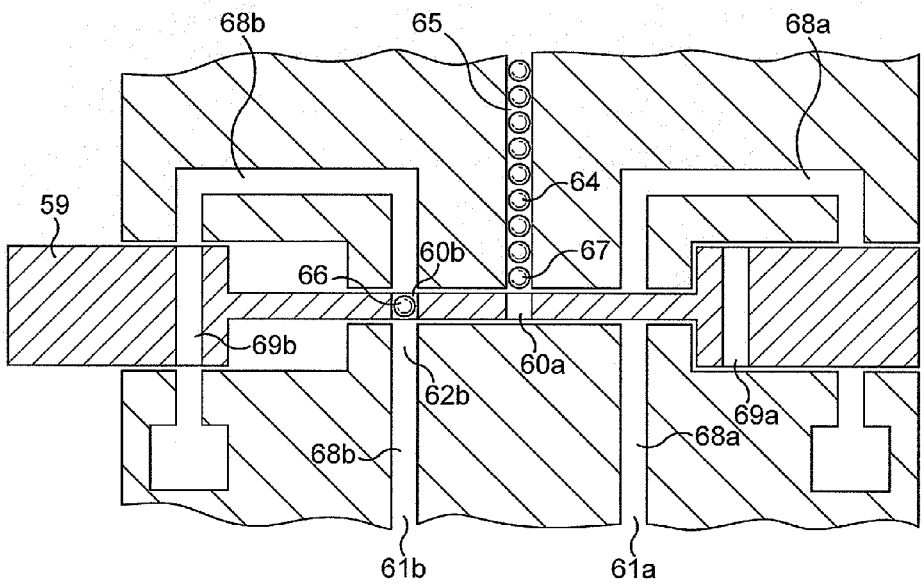

The reciprocating rod is then moved leftwards so that the left hand recess 60*b* is aligned with the mouth of the left tube 61*b* and the right hand recess 60*a* is aligned with the column of capsules 64 in the channel 65. In this way, the capsule 66 is transferred to the mouth 62*b* of the left tube 61*b*. FIG. 19B shows this step in the instant before the capsule 66 held in the left hand recess 60*b* is propelled into the tube 61*b* and the bottommost capsule in the vertical column 64 falls into the right hand recess 60*a*. As shown, the rod 59 is positioned such that a jet of air may pass through the channels 68*b*, 69*b* to propel capsule 66 into tube 61*b*. As shown, the path of air through the channels 68*a*, 69*a* is blocked by the rod 59.

Figure 19C:
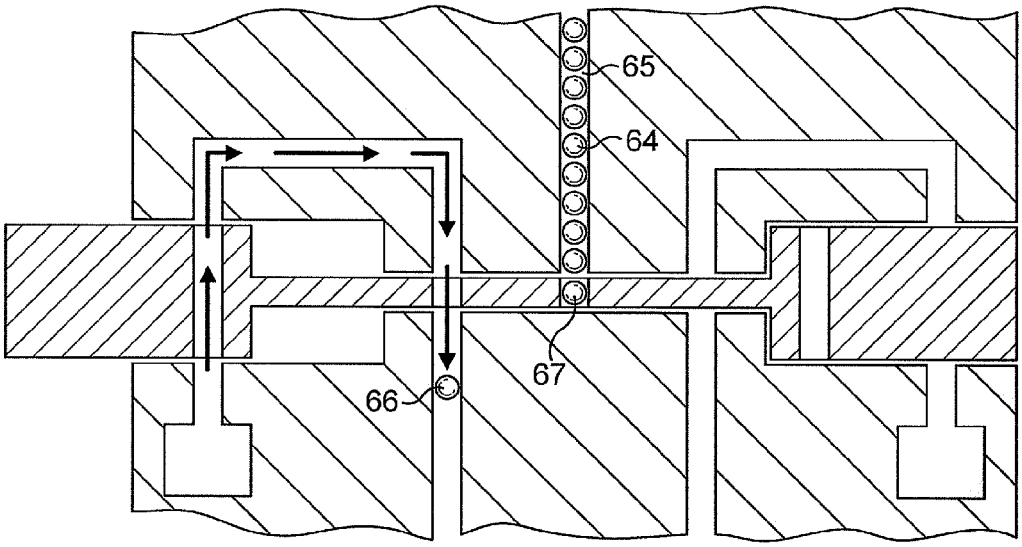

FIG. 19C shows the next step where the capsule 66 has been ejected from the left hand recess 60*b* under the influence of gravity and propulsion by compressed air and the bottommost capsule 67 in the channel falls into the right hand recess 60*a*.

Figure 19D:
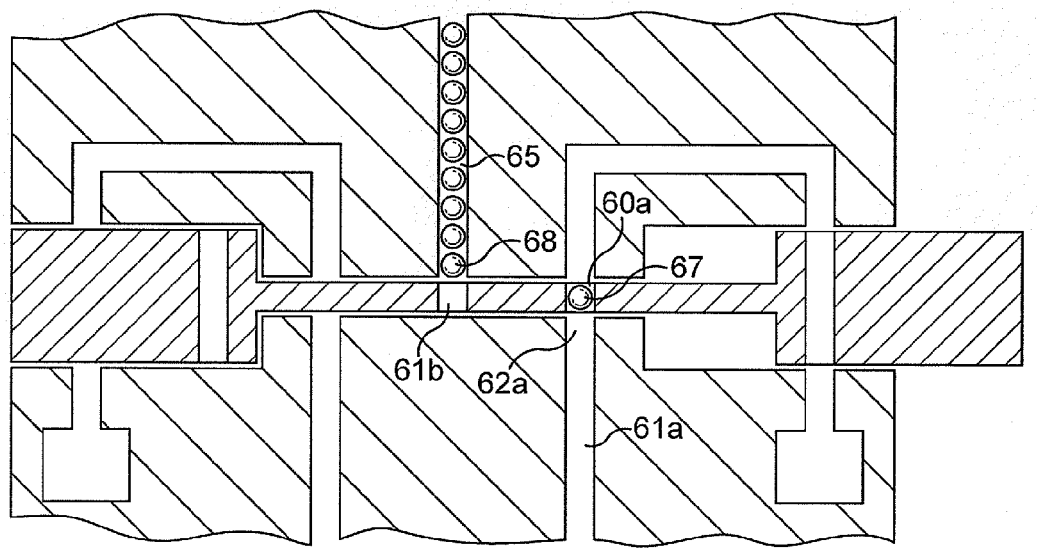

The reciprocating rod then shifts rightwards to the position shown in FIG. 19D. As shown, in this position the right hand recess 60*a* is aligned with the mouth 62*a* of the right tube 61*a* and the left hand recess is aligned with the channel 65. This step is shown in the instant before the capsule 67 in the right hand recess is propelled into the outlet and before the bottommost capsule in the channel 65 falls into the left hand recess 60*b*. The next step in the operation of the delivery means is represented by FIG. 8A and so the process repeats itself.

Although FIGS. 19A-D show various stages in the operation of one reciprocating rod 59, it will be understood that the other reciprocating rods 59 may operate in a similar fashion.

The left and right tubes 61*b*, 61*a* corresponding to each rod 59 are converged into a single tube, which is subsequently converged with the corresponding tubes from the other transfer units and into a single output tube. Thus, capsules from any of the left or the right tubes 61*b*, 61*a* are guided into the single output tube and into the tow.

FIG. 20 illustrates examples of filter rods which can be manufactured by the machines and methods described herein.

FIG. 20(*a*) shows a filter rod 70 having a single capsule 71 therein. The filter rod 70 comprises a plug of tow 72, which is cylindrically wrapped by a plugwrap 73. The capsule 71 is disposed centrally within the rod 70 and is surrounded by the tow 72.

FIG. 20(*b*) shows a filter rod 74 having two capsules 75, 76 therein. The capsules 75, 76 may contain the same flavourant, or may alternatively contain different flavourants.

FIG. 20(*c*) shows a filter rod 77 having four capsules 78, 79, 80, 81 therein. The capsules 78, 79, 80, 81 may contain the same or different liquid flavourants.

FIG. 21 shows an example of a fluid-filled capsule in the form of breakable gelatin capsule 82. As shown, capsule 82 comprises an outer wall 83 of gelatin and an inner space 84 filled with a liquid flavourant such as menthol.

Although the description above relates to the introduction of fluid-containing capsules such as the capsule 82 into filter rod material during filter rod manufacture, those skilled in the art will appreciate that any object suitable for introduction into filter rods could be alternatively or in addition introduced into the filter rod material, for example pellets, strands, beads or any combination of pellets, strands, beads and capsules.

Many other modifications and variations will be evident to those skilled in the art, that fall within the scope of the following claims:

The invention claimed is:

1. An object insertion mechanism for introducing objects into filter rod material during filter rod manufacture, comprising:

an object hopper; and an object transfer mechanism having an inlet configured to receive objects from the object hopper and an outlet configured to output objects from the object transfer mechanism, the object transfer mechanism including a fixed housing and at least one transfer member, the at least one transfer member configured to reciprocate within the fixed housing along a fixed axis between a first position and a second position;

wherein the at least one transfer member includes a recess and is configured to alternately communicate the recess with the inlet to receive objects when the transfer member is in the first position and communicate the recess with the outlet to output objects when the transfer member is in the second position to transfer objects, wherein the recess is blocked from communicating with the outlet to prevent the transfer of objects from the recess to the outlet when the transfer member is in the first position and the recess is blocked from communicating with the inlet to prevent the transfer of objects from the inlet to the recess when the transfer member is in the second position; and wherein the at least one transfer member is configured to output objects in ordered sequence.

2. The object insertion mechanism for introducing objects into filter rod material according to claim 1 in combination with a filter rod manufacturing machine configured to manufacture filter rods from the filter rod material, wherein the at least one transfer member is configured to output objects in ordered sequence such that each filter rod has a desired arrangement of at least one object longitudinally disposed therein.

3. The object insertion mechanism according to claim 1, wherein the object transfer mechanism comprises a plurality of transfer members configured to reciprocate in the fixed housing.

4. The object insertion mechanism according to claim 1, wherein the object transfer mechanism comprises four transfer members, said four transfer members being configured to reciprocate in the fixed housing.

5. The object insertion mechanism according to claim 3, wherein the transfer members are configured to output objects at different times.

6. The object insertion mechanism according to claim 3, wherein the plurality of transfer members are configured to operate successively.

7. The object insertion mechanism according to claim 5, further comprising a combining member configured to combine objects output by the transfer members and to output a combined sequence of objects for introduction into filter rod material.

8. The object insertion mechanism according to claim 1, further comprising one or more tubes directly connecting an output of said at least one transfer member to a point of insertion into filter rod material.

9. The object insertion mechanism according to claim 1, further comprising an object reservoir, wherein the object hopper is arranged to receive objects from the object reservoir.

10. The object insertion mechanism according to claim 9, wherein the object reservoir comprises first and second storage units for containing first and second object types for introduction into filter rod material.

11. The object insertion mechanism according to claim 10, wherein the first and second object types are alternately introduced into the filter rod material.

12. The object insertion mechanism according to claim 9, wherein the object reservoir is arranged to feed objects to the object hopper.

13. The object insertion mechanism according to claim 9, wherein the object reservoir comprises:

a rotatable dish for containing objects, comprising a plurality of inlets connected to the object hopper;

wherein the dish is configured to rotate such that the objects contained in the dish are centrifugally urged towards the edge thereof and pass into the inlets and into the object hopper.

14. The object insertion mechanism according to claim 1, further comprising an object propulsion mechanism configured to propel objects from the object transfer mechanism.

15. The object insertion mechanism according to claim 1, further comprising a fluid flow generating mechanism to generate a fluid flow for transferring objects from the object transfer mechanism.

16. The object insertion mechanism according to claim 15, wherein the fluid flow generating mechanism is configured to transfer objects in a direction transverse to an axis along which the at least one transfer member is configured to reciprocate.

17. The object insertion mechanism according to claim 1 wherein the object hopper is configured to transfer objects to a transfer member in a direction transverse to an axis along which the transfer member is configured to reciprocate.

18. The object insertion mechanism according to claim 1, wherein the object insertion mechanism comprises an object propulsion mechanism, wherein the object propulsion mechanism is actuated in response to the positioning of the transfer member in the second position.

19. The object insertion mechanism according to claim 1 wherein the object insertion mechanism comprises an object propulsion mechanism, wherein the object propulsion mechanism comprises a first port on a first side of the transfer member and a second port on a second, opposite, side of the transfer member;

wherein the first and second ports are aligned with an object in an eject position of the transfer member;

and the object propulsion mechanism is configured to propel a fluid through the first and second ports and the transfer member to output the object.

20. The object insertion mechanism according to claim 18 wherein, the object propulsion mechanism comprises at least one air channel for connection to a source of pressurised air, wherein a part of said air channel extends through said transfer member, such that in the first position the transfer member blocks passage of air through the air channel, and in the second position the said part of the air channel extending through the transfer member completes the air channel.

21. The object insertion mechanism according to claim 1, wherein the at least one transfer member reciprocates in a substantially horizontal plane.

22. The object insertion mechanism according to claim 1, wherein the object hopper is arranged to store objects in one or more channels.

23. The object insertion mechanism according to claim 1, wherein objects drop under gravity into the at least one transfer members and are thereby received therein.

24. The object insertion mechanism according to claim 1, wherein objects are received in at least one hole formed in the at least one transfer member.

25. The object insertion mechanism according to claim 24 wherein the at least one hole inhibits movement of the object within the at least one transfer member in both directions along an axis on which the at least one transfer member is configured to reciprocate.

26. The object insertion mechanism according to claim 1, wherein the at least one transfer member is configured to receive objects in the first position and in the second position such that:

objects received in the first position are output from the transfer member when the transfer member is in the second position; and objects received in the second position are output from the transfer member when the transfer member is in the first position.

27. The object insertion mechanism according to claim 26, wherein the transfer member comprises first and second recesses and wherein:

objects are received into the first recess when the transfer member is in the first position and are received into the second recess when the transfer member is in the second position.

28. The object insertion mechanism according to claim 1, wherein the object transfer mechanism is configured to receive frangible fluid-containing capsule objects.

29. The object insertion mechanism according to claim 1, wherein the object transfer mechanism is configured to receive:

frangible capsule objects containing a first fluid; and frangible capsule objects containing a second fluid.

30. The object insertion mechanism according to claim 1, wherein the at least one transfer members comprise at least one rod.

31. The object insertion mechanism according to claim 30, wherein the object transfer mechanism comprises a rod driving mechanism, the rod driving mechanism having a rotatable axle and at least one eccentric member mounted eccentrically relative to said axle, wherein the at least one eccentric member is connected to the at least one rod and is configured to provide reciprocating motion.

32. The object insertion mechanism according to claim 1, wherein the housing has at least one outlet, wherein in use objects are output from the object transfer mechanism via said at least one outlet.

33. The object insertion mechanism according to claim 32, wherein the at least one transfer member is configured to transfer objects to one of said outlets.

34. The object insertion mechanism according to claim 1, wherein at least one transfer member is configured to transfer objects to an output position, wherein the object transfer mechanism is so configured that in use, an object is output from the object transfer mechanism when positioned in the output position.

35. The object insertion mechanism according to claim 1, wherein the housing has at least one inlet, wherein in use objects are received into the at least one transfer members via said at least one inlet.

36. The object insertion mechanism according to claim 1 wherein the object insertion mechanism is configured to output objects from a transfer member in a direction transverse to an axis along which the transfer member is configured to reciprocate.

37. A method for introducing objects into filter rod material during filter rod manufacture, comprising:

receiving objects at an object transfer mechanism, from an object hopper, the object transfer mechanism comprising an inlet configured to receive objects from the object hopper, an outlet for outputting objects from the object transfer mechanism, a fixed housing and at least one transfer member, the at least one transfer member configured to reciprocate linearly within the fixed housing between a first position and a second position, wherein the at least one transfer member includes a recess and is configured to alternately communicate the recess with the inlet to receive objects when the transfer member is in the first position and communicate the recess with the outlet to output objects when the transfer member is in the second position to transfer objects, wherein the recess is blocked from communicating with the outlet to prevent the transfer of objects from the recess to the outlet when the transfer member is in the first position and the recess is blocked from communicating with the inlet to prevent the transfer of objects from the inlet to the recess when the transfer member is in the second position;

transferring received objects from the first position to the second position; and outputting objects in ordered sequence from the second position.

38. The method according to claim 37, further comprising manufacturing filter rods from filter rod material, wherein the at least one transfer member is configured to output objects in the ordered sequence such that each filter rod has a desired arrangement of at least one object longitudinally disposed therein.

* * * * *